US008839877B1

(12) United States Patent
Fischer

(10) Patent No.: US 8,839,877 B1
(45) **Date of Patent: *Sep. 23, 2014**

(54) LOW PRESSURE, EXTENDED COVERAGE, FIRE PROTECTION SPRINKLER

(71) Applicant: Tyco Fire Products LP, Lansdale, PA (US)

(72) Inventor: Michael A. Fischer, West Kingston, RI (US)

(73) Assignee: Tyco Fire Products LP, Landsdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/791,839

(22) Filed: Mar. 8, 2013

Related U.S. Application Data

(60) Continuation of application No. 13/354,213, filed on Jan. 19, 2012, which is a continuation of application No. 12/368,973, filed on Feb. 10, 2009, now Pat. No. 8,122,969, which is a continuation of application No. 11/240,383, filed on Oct. 3, 2005, now Pat. No. 7,584,802, which is a continuation of application No. 10/762,275, filed on Jan. 23, 2004, now Pat. No. 6,976,543, which is a division of application No. 09/718,785, filed on Nov. 22, 2000, now abandoned.

(51) Int. Cl.
*A62C 37/08* (2006.01)
*A62C 37/11* (2006.01)

(52) U.S. Cl.
CPC ..... *A62C 37/11* (2013.01)
USPC ..... 169/37; 169/41

(58) Field of Classification Search
CPC ..... A62C 35/58; A62C 37/12
USPC ..... 169/37, 41, 42, 38, 16, 17
See application file for complete search history.

(56) References Cited

U.S. PATENT DOCUMENTS

| | | | |
|---|---|---|---|
| 269,930 | A | 1/1883 | Harris |
| 306,662 | A | 10/1884 | Stratton |
| 316,581 | A | 4/1885 | Stratton |

(Continued)

FOREIGN PATENT DOCUMENTS

| | | |
|---|---|---|
| AU | 199865360 | 9/1998 |
| CA | 2462636 | 8/2005 |

(Continued)

OTHER PUBLICATIONS

USPTO for USP 7,624,812 to Pahila REL00039203-00039526.

(Continued)

*Primary Examiner* — Davis Hwu
(74) *Attorney, Agent, or Firm* — Perkins Coie LLP

(57) ABSTRACT

A low pressure, extended coverage, fire protection sprinkler, e.g., of the upright type, suitable for use in protection of at least extra hazard and high piled storage occupancies, in accordance with the 1999 Edition of NFPA 13, has a body with an internal passageway extending between an inlet end and an opposite outlet end, and a deflector mounted to the body by at least one support arm and disposed in alignment with the axis and generally spaced from the outlet end of the internal passageway. The sprinkler has a predetermined K-factor, e.g., of greater than about 16.0. The sprinkler is configured and arranged to deflect flow of water generally radially outwardly and downwardly of the sprinkler in a predetermined spray pattern. Preferably, the predetermined spray pattern has a generally polygonal shape, e.g., a rectangular shape, when viewed at a predetermined distance below the deflector.

31 Claims, 6 Drawing Sheets

(56) References Cited

U.S. PATENT DOCUMENTS

| | | | |
|---|---|---|---|
| 433,477 | A | 8/1890 | Lapham |
| 514,162 | A | 2/1894 | Newton |
| 546,087 | A | 9/1895 | Carpenter |
| 575,121 | A | 1/1897 | Lapham |
| 640,757 | A | 1/1900 | Gates et al. |
| 720,013 | A | 2/1903 | Esty |
| 824,128 | A | 6/1906 | Martin |
| 1,165,313 | A | 12/1915 | Bower |
| 1,285,133 | A | 11/1918 | Gross |
| 1,338,469 | A | 4/1920 | Waage et al. |
| 1,816,016 | A | 7/1931 | Knight |
| 1,903,150 | A | 3/1933 | Tyden |
| 2,025,063 | A | 12/1935 | Loepsinger |
| 2,135,138 | A | 11/1938 | Kendall |
| 2,155,990 | A | 4/1939 | Hodgman, Jr. |
| 2,180,258 | A | 11/1939 | Rowley |
| 2,211,399 | A | 8/1940 | Winslow |
| 2,291,813 | A | 8/1942 | Knight |
| 2,291,818 | A | 8/1942 | Loepsinger |
| 2,357,227 | A | 8/1944 | Rowley |
| 2,558,450 | A | 6/1951 | Martin |
| 2,591,872 | A | 4/1952 | Rider |
| 2,697,008 | A | 12/1954 | Rowley |
| 2,724,614 | A | 11/1955 | Rider |
| 2,732,018 | A | 1/1956 | Grimes |
| 2,768,696 | A | 10/1956 | Sherburne |
| 2,862,565 | A | 12/1958 | Dukes |
| 2,871,953 | A | 2/1959 | Bray |
| 3,007,528 | A | 11/1961 | Gloeckler |
| 3,061,015 | A | 10/1962 | Cann, Jr. |
| 3,067,823 | A | 12/1962 | Kavanagh |
| 3,080,000 | A | 3/1963 | Gloeckler |
| 3,135,331 | A | 6/1964 | Lee |
| 3,195,647 | A | 7/1965 | Campbell et al. |
| 3,401,751 | A | 9/1968 | Loftin et al. |
| 3,414,112 | A | 12/1968 | Ravn |
| 3,525,402 | A | 8/1970 | Hattori |
| 3,561,537 | A | 2/1971 | Dix et al. |
| 3,584,689 | A | 6/1971 | Willms |
| 3,625,289 | A | 12/1971 | Gloeckler |
| 3,653,444 | A | 4/1972 | Livingston |
| 3,675,894 | A | 7/1972 | Friedell |
| 3,682,251 | A | 8/1972 | Livingston |
| 3,716,103 | A | 2/1973 | Tanaka et al. |
| 3,722,596 | A | 3/1973 | Livingston |
| 3,743,022 | A | 7/1973 | Livingston |
| 3,768,736 | A | 10/1973 | Cox |
| 3,783,947 | A | 1/1974 | Dix et al. |
| 3,802,512 | A | 4/1974 | Todtenkopf |
| 3,812,915 | A | 5/1974 | Livingston |
| 3,818,994 | A | 6/1974 | Livingston |
| 3,834,463 | A | 9/1974 | Allard et al. |
| 3,888,313 | A | 6/1975 | Freeman |
| 3,896,880 | A | 7/1975 | Asp |
| 3,904,126 | A | 9/1975 | Allard |
| 3,924,687 | A | 12/1975 | Groos |
| 3,927,805 | A | 12/1975 | Stull |
| 3,970,218 | A | 7/1976 | Lee |
| 4,007,878 | A | 2/1977 | Anderson |
| 4,014,388 | A | 3/1977 | Anderson |
| 4,015,665 | A | 4/1977 | Simons et al. |
| 4,066,129 | A | 1/1978 | Anderson |
| 4,079,786 | A | 3/1978 | Moling |
| 4,091,872 | A | 5/1978 | Mountford |
| 4,091,873 | A | 5/1978 | Werner |
| 4,099,675 | A | 7/1978 | Wohler et al. |
| 4,105,076 | A | 8/1978 | Simons et al. |
| 4,113,021 | A | 9/1978 | Werner |
| 4,121,665 | A | 10/1978 | Woycheese |
| 4,136,740 | A | 1/1979 | Groos et al. |
| 4,139,062 | A | 2/1979 | Rago |
| 4,150,811 | A | 4/1979 | Condit |
| 4,177,862 | A | 12/1979 | Bray |
| 4,220,208 | A | 9/1980 | Jackson et al. |
| 4,228,858 | A | 10/1980 | Sclafani |
| 4,237,982 | A | 12/1980 | Sclafani |
| 4,258,795 | A | 3/1981 | Hansen |
| 4,273,195 | A | 6/1981 | Fischer et al. |
| 4,279,309 | A | 7/1981 | Fischer et al. |
| 4,280,562 | A | 7/1981 | Glinecke |
| 4,296,815 | A | 10/1981 | Mears |
| 4,296,816 | A | 10/1981 | Fischer |
| 4,403,626 | A | 9/1983 | Paul, Jr. |
| 4,405,018 | A | 9/1983 | Fischer |
| 4,417,626 | A | 11/1983 | Hansen |
| 4,580,729 | A | 4/1986 | Pounder |
| 4,585,069 | A | 4/1986 | Whitaker |
| 4,625,915 | A | 12/1986 | Cockman |
| 4,630,682 | A | 12/1986 | Pieczkolan |
| 4,657,085 | A | 4/1987 | Jacobsen |
| 4,732,216 | A | 3/1988 | Polan |
| 4,800,961 | A | 1/1989 | Klein |
| 4,880,063 | A | 11/1989 | Leininger et al. |
| 4,893,679 | A | 1/1990 | Martin et al. |
| 4,901,799 | A | 2/1990 | Pepi et al. |
| 4,930,578 | A | 6/1990 | Barnett et al. |
| 4,976,320 | A | 12/1990 | Polan |
| 4,981,179 | A | 1/1991 | Klein |
| 5,020,601 | A | 6/1991 | Retzloff et al. |
| 5,022,468 | A | 6/1991 | Byrne |
| 5,036,923 | A | 8/1991 | Shea, Sr. |
| 5,094,298 | A | 3/1992 | Polan |
| 5,143,657 | A | 9/1992 | Curtis |
| 5,152,344 | A | 10/1992 | Fischer et al. |
| 5,188,185 | A | 2/1993 | Mears |
| 5,190,222 | A | 3/1993 | Haruch |
| 5,195,592 | A | 3/1993 | Simons |
| 5,228,520 | A | 7/1993 | Gottschalk |
| 348,719 | A | 7/1994 | Dolan |
| D348,719 | S | 7/1994 | Dolan |
| 5,333,794 | A | 8/1994 | Haruch |
| 5,366,022 | A | 11/1994 | Meyer et al. |
| 5,373,989 | A | 12/1994 | Hattori |
| 5,392,993 | A | 2/1995 | Fischer |
| 5,415,239 | A | 5/1995 | Kotter et al. |
| 5,523,682 | A | 6/1996 | Leon |
| 5,553,576 | A | 9/1996 | Nikly |
| 5,570,713 | A | 11/1996 | Stoltz et al. |
| 5,579,846 | A | 12/1996 | Meyer et al. |
| 5,584,344 | A | 12/1996 | Meyer et al. |
| 5,609,211 | A | 3/1997 | Meyer et al. |
| 5,628,367 | A | 5/1997 | Truax et al. |
| 5,664,630 | A | 9/1997 | Meyer et al. |
| 5,669,449 | A | 9/1997 | Polan et al. |
| 5,687,914 | A | 11/1997 | Bosio et al. |
| 5,722,599 | A | 3/1998 | Fries |
| 5,753,149 | A | 5/1998 | Shepherd et al. |
| 5,775,431 | A | 7/1998 | Ondracek |
| 5,810,263 | A | 9/1998 | Tramm |
| 5,829,532 | A | 11/1998 | Meyer et al. |
| 5,829,684 | A | 11/1998 | Fischer |
| 5,839,667 | A | 11/1998 | Fishcer |
| 5,862,994 | A | 1/1999 | Pounder et al. |
| 5,865,256 | A | 2/1999 | Pounder |
| 5,890,657 | A | 4/1999 | Ponte |
| 5,915,479 | A | 6/1999 | Ponte |
| 5,957,392 | A | 9/1999 | Pincus |
| 5,967,240 | A | 10/1999 | Ondracek |
| 6,000,473 | A | 12/1999 | Reilly |
| 6,029,749 | A | 2/2000 | Reilly et al. |
| 6,059,044 | A | 5/2000 | Fischer |
| 6,098,718 | A | 8/2000 | Sato |
| 6,152,236 | A | 11/2000 | Retzloff et al. |
| 6,155,494 | A | 12/2000 | Fabbri et al. |
| 6,158,520 | A | 12/2000 | Reilly et al. |
| 6,216,793 | B1 | 4/2001 | Sundholm |
| 6,246,333 | B1 | 6/2001 | Doner et al. |
| 6,276,460 | B1 | 8/2001 | Pahila |
| 6,367,559 | B1 | 4/2002 | Winebrenner |
| 6,446,732 | B1 | 9/2002 | Polan |
| 6,450,265 | B1 | 9/2002 | Ponte |
| 6,454,017 | B1 | 9/2002 | Fischer et al. |
| 6,502,643 | B1 | 1/2003 | Meyer et al. |
| 6,554,077 | B2 | 4/2003 | Polan |

(56) References Cited

U.S. PATENT DOCUMENTS

| | | | |
|---|---|---|---|
| 6,851,482 | B2 | 2/2005 | Dolan |
| 6,868,917 | B2 | 3/2005 | Meyer et al. |
| 6,976,543 | B1 | 12/2005 | Fischer |
| 7,036,603 | B2 | 5/2006 | Thomas et al. |
| 7,143,834 | B2 | 12/2006 | Dolan |
| 7,165,624 | B1 | 1/2007 | Fischer |
| 7,275,603 | B2 | 10/2007 | Polan |
| 7,559,376 | B2 | 7/2009 | Silva, Jr. |
| 7,584,802 | B1 | 9/2009 | Fischer |
| 7,624,812 | B2 | 12/2009 | Pahila |
| 7,730,959 | B2 | 6/2010 | Fischer |
| 7,735,570 | B2 | 6/2010 | Fischer |
| 7,819,201 | B2 | 10/2010 | Pounder et al. |
| 2002/0050531 | A1 | 5/2002 | Dolan |
| 2003/0075343 | A1 | 4/2003 | Ballard |
| 2005/0121206 | A1 | 6/2005 | Dolan |
| 2005/0173562 | A1 | 8/2005 | Franson et al. |
| 2006/0060361 | A1 | 3/2006 | Pounder et al. |
| 2006/0102362 | A1 | 5/2006 | Polan |
| 2006/0113093 | A1 | 6/2006 | Silva, Jr. |
| 2007/0114047 | A1 | 5/2007 | Fischer |
| 2007/0187116 | A1 | 8/2007 | Jackson et al. |
| 2007/0246232 | A1 | 10/2007 | Pahila |
| 2008/0257564 | A1 | 10/2008 | Cordell et al. |
| 2009/0126950 | A1 | 5/2009 | Rogers |
| 2009/0211772 | A1 | 8/2009 | Silva, Jr. |
| 2009/0294138 | A1 | 12/2009 | Jackson et al. |
| 2010/0032173 | A1 | 2/2010 | Fischer |
| 2010/0071916 | A1 | 3/2010 | Fischer |

FOREIGN PATENT DOCUMENTS

| | | | |
|---|---|---|---|
| CA | 2358744 | | 9/2009 |
| DE | 2508355 | A1 | 9/1976 |
| DE | 2700431 | A1 | 7/1978 |
| DE | 3910287 | A1 | 10/1990 |
| DE | 4103862 | | 8/1992 |
| DE | 4136912 | A1 | 5/1993 |
| DE | 4480591 | T1 | 3/1996 |
| DE | 4480591 | C2 | 11/2000 |
| EP | 0 695 562 | A2 | 2/1996 |
| GB | 765125 | | 1/1957 |
| GB | 1307095 | | 2/1973 |
| GB | 1556217 | | 11/1979 |
| GB | 1570080 | | 6/1980 |
| GB | 8708851.7 | | 9/1987 |
| GB | 2195241 | A | 4/1988 |
| GB | 2206043 | A | 12/1988 |
| GB | 2293337 | A | 3/1996 |
| GB | 2293337 | B | 8/1997 |
| GB | 2336777 | | 11/1999 |
| JP | 49-98198 | | 8/1974 |
| JP | 50-16793 | | 2/1975 |
| JP | 54-143100 | | 10/1979 |
| JP | 3-27259 | | 3/1991 |
| JP | 4-150873 | | 5/1992 |
| JP | 04-329969 | | 11/1992 |
| JP | 11-104262 | | 4/1999 |
| WO | WO 82/00603 | | 3/1982 |
| WO | WO 95/19851 | | 7/1995 |
| WO | WO98/18525 | | 5/1998 |
| WO | WO 98/28042 | | 7/1998 |
| WO | WO 2006/058330 | | 6/2006 |

OTHER PUBLICATIONS

USPTO for USP 7,730,959 to Fischer REL00041834-00042755.

Excerpt from "UL 199, Standard for Automatic Sprinklers for Fire-Protection Service," (Apr. 8, 1997), describing 10 Pan Distribution Test, pp. 31-32 REL00042823-REL00042824.

Underwriters Laboratories Inc., UL 1767, "Standard for Safety, Early-Suppression Fast-Response Sprinklers," First Edition, Feb. 1990. REL00042825-REL00042855.

Factory Mutual Engineering Corp., "Loss Prevention Data 2-2, Early Suppression Fast Responses Sprinklers," Apr. 1987 REL00042856-REL00042864.

Factory Mutual Research, "Approval Standard, Early Suppression Fast Responses Automatic Sprinklers," Jun. 1986 REL00042865-REL00042923.

"Automatic" Sprinkler Corporation of America product sheets entitled Automatic ESFR Glass Bulb Sprinkler, Feb. 1988, pp. J 5.3, J 5.4. REL00042924-REL00042925.

ASCOA First Systems data sheets entitled "Automatic ESFR Glass Bulb Sprinkler," Mar. 1992, pp. 1.1, 1.2. REL00042926-REL00042927.

Grinnell Corporation data sheets entitled "Early Suppression Fast Response Sprinklers/Model ESFR-1 Pendent, 14.3 K-Factor," Apr. 1988. REL00042928-REL00042929.

Reliable Automatic Sprinkler product announcement, "ESFR Model H Early Suppression Fast Response Sprinklers," Oct. 1992, 3 pp. total. REL00042930-REL00042932.

Central Sprinkler Company catalog sheets entitled Central ESFR-1 3-93/ESFR Early Suppression Fast Response, Mar. 1993, 4 pps. REL00042933-00042936.

Drawing entitled, "International Jumbo Sprinkler Head-Deflector," DWG No. 1-117, Automatic Sprinkler Co. of America, Mar. 1926, 1 pg. REL00042937.

Sheet entitled, "Grinnell Jumbo Sprinkler Issue A," Grinnell Corp., Feb. 1969, 1 pg. REL00042938.

Drawing entitled "Solder-Type-Issue A 1/14," Grinnell Sprinkler Yoke, Body, Strut, Diaphragm and Disc, General Fire Extinguisher Company, Apr. 1917, 1 pg. REL00042939.

Drawing entitled "1 Grinnell Jumbo Sprinkler Detail Solder Type Issue A," General Fire Extinguisher Co., Apr. 1917, 1 pg. REL00042940.

NJ Thompson, Fire Behavior and Sprinklers, Chapter 6, "Automatic Sprinkler Protection," National Fire Protection Association, 1964, Forward, Table of Contents, pp. 72-91. REL00042941-REL00042953.

Newsletter for Fire Protection Engineers and Industry, No. 11, Jul. 1968, Orinda, California, 8 pp. REL00042954-REL00042961.

D.G. Goodfellow et al., Technical Report entitled "Optimization of Sprinkler Protection for United States Postal Service III. Protection of Plastic Letter Trays," Factory Mutual Research Corp., Oct. 1971, 39 pp. REL00042962-REL00043000.

D.G. Goodfellow et al., Technical Report entitled "Optimization of Sprinkler Protection for United States Facilities/IV Protection of Plastic Letter Trays with 0.64-in. Retrofit Sprinklers," Factory Mutual Research Corporation, Jul. 1974, 30 pp. with cover and introductory pages. REL00043001-REL00043030.

E.W.J. Troup, Technical Report entitled "New Developments in Ceiling-Level Protection for the High-Challenge Fire," Factory Mutual Research Corporation, Jan. 1974. REL00043031-REL00043066.

P.J. Chicarello et al., Technical Report entitled "Large-Scale Fire Test Evaluation of Early Suppression Fast Response (ESFR) Automatic Sprinklers," Factory Mutual Research Corp. May 1986, cover-p. 18, pp. 122-128. REL00043067-REL00043096.

C. Yao, "The Development of the ESFR Sprinkler System," First Safety Journal, Elsevier Scientific Ltd., Kidlington, Oxford, 1988, vol. 14, No. 11, pp. 65-73. REL00043097-REL00043105.

C. Yao, "Overview of FMRC's Sprinkler Technology Research," Factory Mutual Research Corporation, May 1992. REL00043106-REL00043132.

Approved Product News, Factory Mutual Engineering Corp., vol. 4, No. 2, Dec. 1998, pp. 1-5, 8-12, 16. REL00043133-REL00043134.

Fire Protection Handbook, 17$^{th}$ Edition, National Fire Protection Association, 1991, Title page, inner page, Table of Contents, p. IX and pp. 5-127 through 5-163 and 5-174 through 5-197. REL00043135-REL00043186.

K. Bell, "Presentation to American Fire Sprinkler Association-Large K-Factor Sprinklers," Nov. 1992, 59 pp. total; 19 pp. text and 40 pp. slide photocopies REL00043187-REL00043245.

Search Report under Section 17, issued by GB Patent Office for corresponding GB Patent Application No. 9911294.8, dated Aug. 24, 1999. REL00043246.

(56) References Cited

OTHER PUBLICATIONS

National Fire Protection Associate, NFPA 13—Standard for the Initiation of Sprinkler System, 1996 edition, pp. 13-1 through 13-148. REL00043247-REL00043294.
National Fire Protection Associate, NFPA 231—Standard for General Storage, 1998 edition, pp. 231-1 through 231-31. REL00043395-REL00043425.
National Fire Protection Associate, NFPA 231C—Standard for Rack Storage of Materials, 1998 edition, pp. 231C-1 through 231C-75. REL00043426-REL00043500.
File History of U.S. Appl. No. 09/292,152, filed Apr. 15, 1999, now U.S. Patent No. 7,165,624, Michael Fischer. REL00043501-REL00044194.
File History of U.S. Appl. No. 09/134,493, filed Aug. 14, 1998, now U.S. Patent No. 6,059,044, Michael Fischer. REL00044195-REL00044410.
File History of U.S. Appl. No. 09/079,789, filed May, 15, 1998, now Abandoned, Michael Fischer. REL00044411-REL00044801.
McCormick, Michael G., Staff Engineering Associate, Letter From Underwriters Laboratories Inc., re: Central K25.2 ESFR Sprinkler 10-Pan Distribution Test, Sep. 5, 2007. (3 pages). REL00044802-REL00044804.
Color photocopies of six color photographs of sprinkler case with "I.S. Co." on deflector and PAT.03 on the body and 1903 stamped on the release link, labeled Jun. 1995, 2 pp.; color photocopies of six color photographs of sprinkler case with "Globe" and 280 on body, G A S Co. on deflector and stamped 1926 on release ink, labeled Jun. 1995, 2 pp.; Color photocopies of five color photographs of Grinnell Corporation "Jumbo A Automatic Sprinkler-1 ¼" Orifice, labeled Jun. 1995, 2 pp; Color photocopies of five color photographs of Grinnell Corporation, "Jumbo A" automatic sprinkler—1 orifice, labeled Jun. 1995, 2 pp., body painted red. REL00044805-REL00044812.
Sprinkler Photo. REL00044813.
The Reliable Automatic Sprinkler Co., Inc., Datasheet—Model G VELO PEND Specific Application NFPA 231C .6 Density/2,000 Sq. Ft., Bulletin 149A, Oct. 1997, REL00044814-00044815.
The Reliable Automatic Sprinkler Co., Inc., Datasheet—Model G VELO PEND Very Extra Large Orifice Pendent Sprinkler, NFPA 13,231,and 231C, Bulletin 146A, Oct. 1997, REL00044816-REL00044817.
Central Sprinkler Company Data Sheets for "Ultra K25 ESFR Low Pressure Early Suppression Fast Response" (4 pages) (1998). REL00044818-REL00044821.
GEM Sprinkler Company, Datasheet for Early Suppression Fast Response Sprinklers, Model ESFR-25™ Pendent, 25.2 K-Factor, 1 inch NPT, Feb. 2000, (4 pages), REL00044822-REL00044825.
GEM Sprinkler Company, Datasheet for Early Suppression Fast Response Sprinklers (FM) & Specific Application ESFR Sprinklers (UL & C-UL), Model ESFR-25™ Pendent, Nov. 1998, (4 pages) REL00044826-REL00044829.
Plaintiff Tyco—Complaint in *Tyco Fire Products LP* (Plaintiff Tyco) v. *The Viking Corp.* (6 pages) (Defendant Viking) (Apr. 26, 2007). REL00044830-REL00044835.
Defendant Viking—Answer to Complaint, Affirmative Defenses, Counterclaims and Jury Demand (13 pages) (May 16, 2007). REL00044836-REL00044848.
Plaintiff Tyco—Motion to Strike Affirmative Defenses and Memorandum of Law in Support of Motion to Strike; Reply to Counterclaim of Defendant (14 pages) (Jun. 4, 2007). REL00044849-REL00044862.
Plaintiff Tyco—Motion for Preliminary Injunction; Memorandum of Law in Support; Proposed Order; Declaration of J. Golinveaux (46 pages) (Jun. 13, 2007). REL00044863-REL00044908.
Plaintiff Tyco—Declaration of Donald Pounder in Support of Motion for Preliminary Injunction (37 pages) (Jun. 14, 2007). REL00044909-REL00044945.
Defendant Viking—Motion for Leave to Amend Answer to Complaint, Counterclaims and Jury Demand; Memorandum in Support of Motion; Exhibits A-C (42 pages) (Jun. 21, 2007). REL00044946-REL00044987.
Defendant Viking—Response in Opposition to Plaintiff's Motion to Strike Affirmative Defenses; Proposed Order; Index of Exhibits; Exhibits A-E (95 pages) (Jun. 21, 2007). REL00044988-REL00045082.
Defendant Viking—Response in Opposition to Plaintiff Motion for Preliminary Injunction; Proposed Order; Index of Exhibits; Exhibits A-D, Exhibits F-S (217 pages) (Jul. 16, 2007). REL00045083-REL0045299.
Defendant Viking—Declaration of T. Deegan in Support of Opposition to Plaintiff Motion for Prelim. Injunction, Appendices A1, B1, C1, Exhibits 1-27 (372 pages) (Jul. 17, 2007). REL00045300-REL00045671.
Defendant Viking—Declaration of S. Franson in Support of Opposition to Plaintiff Motion for Preliminary Injunction (7 pages) (Jul. 17, 2007). REL00045672-REL00045678.
Defendant Viking—First Amended Answer to Complaint, Affirmative Defenses, Counterclaims and Jury Demand (14 pages) (Jul. 19, 2007) REL00045679-REL00045692.
Plaintiff Tyco—First Amended Complaint (6 pages) (Jul. 30, 2007). REL00045693-REL00045698.
Stipulation of Voluntary Dismissal of Action (2 pages) (Jan. 8, 2008). REL00045699-REL00045700.
PACER—Civil Docket for *Tyco Fire Products LP* v. *The Viking Corporation* Case No. 2:07-cv-01683-WY (E.D. Pa) (Aug. 29, 2008). REL00045701-REL00045709.
Sprinkler Photo (VK510 identified as Exhibit C) REL00045784.
Sprinkler Photo (VK503 identified as Exhibit D) REL00045785.
Factory Mutual Research, Preliminary Guidelines, ESFR Sprinklers, Prepared for Participants in the ESFR Program; Jan. 1984 (Identified as Exhibit F). REL00045786-REL00045797.
Transportion and Distribution, "ESFRS: Superior Warehouse Fire Protection", Sep. 1989 (Identified as Exhibit H). REL0004579-REL00045799.
National Engineer, "Early Suppression-Fast Response Sprinklers: A New Level of Industrial Fire Protection", Sep. 1989 (Identified as Exhibit G). REL00045800-REL00045801.
The Viking Corporation; Engineering drawings of Model ESFR 25K Pendent Sprinkler Deflector; Sep. 30, 2002; 1 sheet. REL00045802.
The Viking Corporation; Engineering drawings Deflector, Pendent Sprinkler of Model 17K Dry Pendent Sprinkler; Nov. 29, 2006; 1 sheet. REL00045803.
Gem Sprinkler—Datasheet for Early Suppression Fast Response Sprinklers Model ESFR-1 Pendent, 14.3 K-Factor, Apr. 1988 (2 pages), REL00045804-REL00045805.
Sprinkler Photos, REL00045806-REL00045812.
National Fire Protection Association, NFPA 13 Standard for the Installation of Sprinkler Systems, pp. 13-21 to 13-22, 2 pages, 2002 edition. REL00045813-REL00045815.
Testing Data for Central 1997 K25 ESFR PD—UL 199 Rotating 10 Pan, dated Jul. 12, 2007, 1 page. REL00045816.
National Fire Protection Association, NFPA 13, Special Designs of Storage Protection, 2007 Edition, p. 13-189. REL00045817.
National Fire Protection Association, NFPA 13, Installation of Sprinkler Systems, 2007 Edition, p. 13-186. REL00045818.
Sprinkler Photos, Central 1997 K25 ESFR PD. REL00045819.
Central Sprinkler Company Data Sheets for "Ultra K25 ESFR Low Pressure Early Suppression Fast Response" (4 pages) (1998). REL00045820-REL00045823.
The Viking Corporation—Dry Pendent Sprinklers Model C, Sprinkler 101, Jan. 1987 (4 pages), REL00046079-REL00046082.
Chemetron Fire Systems, Star Model ME-1 Flush Type Dry Pendent REL00046083-REL00046084.
Total Walther Feuerschutz GmbH, Hangender Trockensprinkler GHTS 15, Dry Pendent Sprinkler—Sprinkler Anti-gel, Jan. 17, 1989, 2 pages. REL00046085-REL00046086.
The Reliable Automatic Sprinkler Co., Inc., Datasheet for Model G3 Dry Sprinkler, Bulletin 116D, 4 pages, REL00046087-REL00046090.

(56) References Cited

OTHER PUBLICATIONS

Victaulic Company, Datasheet for 40.61, Models V3608 and V3607 Standard Spray Pendent and Recessed Pendent Standard and Quick Response; 3124, Revision A, 2001, 4 pages, REL00046091-REL00046094.
Victaulic Company, Datasheet for 40.63, Models V3604 and V3603 Dry Type Upright; 3126, Revision A, 2001, 4 pages, REL00046095-REL00046098.
Globe Fire Sprinkler Corporation, Datasheet for Automatic Sprinklers Model J Bulb Spray Series Dry Type Pendent Recessed Pendent, Bulletin ASB-DP, Aug. 1990, 2 pages. REL00046099-REL00046102.
Grinnell Corporation, Datasheet for Dry Pendent Sprinklers, Issue C Solder Type, 1/2" Orifice, Jul. 1986. REL00046103-REL00046106.
Grinnell Corporation, Datasheet for Dry Pendent Sprinklers, Model F960 Designer 1/2" Orifice, Jul. 1986. REL00046107-REL00046110.
Central Sprinkler Corporation, Dry Pendent Sprinklers Recessed, Flush and Extended Types Model "A-1", 1986, REL00046111-REL00046112.
Preussag Minimax. "Sprinkler-Teile/Parts Trockensprinkler dry sprinkler", 2 sheets, Jan. 1989. REL00046113-REL00046114.
Dry Pendent Drop Sprinkler, Data Sheet AS.159, 2 pages REL00046115-REL00046116.
Engineering drawings of the Dry Pendent Drop Sprinkler described in Data Sheet AS.159, 10 pages. REL00046117-REL00046126.
First Sprinkler—Color Photo 01; First Sprinkler—Color Photo 02; First Sprinkler—Color Photo 03; First Sprinkler—Color Photo 04; First Sprinkler—Color Photo 05; Second Sprinkler—Color Photo 06; Second Sprinkler—Color Photo 07; Second Sprinkler—Color Photo 08. REL00046127-REL00046134.
Response to Office Action, US 2007/0187116, Mar. 13, 2008, pp. 1-25. REL00046135-REL00046159.
Office Action, US 2007/0187116, Dec. 13, 2007, pp. 1-13. REL00046160- REL00046172.
Grinnell Corporation; Dry Sprinklers, Quick Response, Data Sheet of Model F960; Jun. 1998; 1 sheet. REL00046173.
Grinnell Corporation; Engineering drawings of Model F960 Dry Pendent Bulb Type Sprinkler Yoke; Rev. Jan. 3, 1991; 1 sheet. REL00046174.
Grinnell Corporation; Engineering drawings of Model F960 Dry Pendent Bulb-Type Sprinkler Assembly; Apr. 24, 1991; 1 sheet. REL00046175.
Viking Corp.; Technical Data, "Model M Quick Response Dry Pendent Sprinkler"; Apr. 9, 1998; 4 sheets. REL00046176-REL00046179.
"Approval Standard for Automatic Sprinklers for Fire Protection;" Class Series 2000; May 1998; Factory mutual Corporation; pp. 1-90. REL00046180-REL00046184.
Underwriters Laboratories Inc.; "UL 199 Standard for Automatic Sprinklers for Fire-Protection Service" (Sections 20 and 29); Apr. 8, 1997; 4 pages. REL00046185-REL00046188.
James E. Golinveaux; "A Technical Analysis: The Use and Maintenance of Dry Type Sprinklers" (http://www.tycoFire.comITFP_common/DrySprinklers.pdf); Jun. 2002; 15 pages. REL00046189-REL00046202.
Victaulic; "Models V3606 and V3605 Dry Type Standard Spray Pendent and Recessed Pendent Standard and Quick Response"; 2002; 4 sheets. REL00046203-REL00046206.
"Duraspeed Sprinkler—Rack Storage—Q-17;" Sprinklers, Nozzles and Accessories/Section 4; Grinnell Fire Protection Systems Company, Inc.; Bulletin No. 211; Jan. 1975; 2 pgs. REL00046265-REL00046266.
"Approval Standard for Early Suppression-Fast Response (ESFR) Automatic Sprinklers;" Class No. 2008; Aug. 1996; Factory Mutual Research Corporation; pp. 1-47. REL00046267-REL00046319.
"Installation of Sprinkler Systems;" NFPA 13; 1999 Edition; National Fire Protection Association. REL00046320-REL00046636.
"Approval Standard for Automatic Sprinklers for Fire Protection;" Class Series 2000; May 1998; Factory mutual Corporation; pp. 1-90. REL00046637-REL00046641.
"Application of the Tyco Fire Products;" Sep. 2007, 21 pages, Tyco Fire & Building Products [online] [retrieved Oct. 30, 2007 from the Internet: URL<http://www.tyco-fire.com/TFP_common/EC25_EC17_WhitePaper.pdf>] REL00046642-REL00046663.
Central Sprinkler Company, Datasheet for Central ESFR Early Suppression Fast Response Pendent Automatic Sprinkler—ESFR-1, 1-95, No. 2-13.0 , 4 pages, 1995, REL00047029-REL00047032.
GEM Sprinkler Company Press Release and Announcement, "Gem Sprinkler Company Introduces New 11.2 K-Factor ECLH Pendent and Recessed Pendent Sprinklers", Oct. 7, 2009, 3 pages, REL00047033-REL00047035.
Page dated Nov. 2004 identifying Viking's K-17 Sprinkler and Viking's Extended Coverage, Ordinary Hazard. REL00047036.
USTO for USP 7,624,812 to Pahila. REL00047057-REL00047443.
USPTO for USP 5,775,431 to Ondracek. REL00047444-REL00047547.
USPTO for USP 5,967,240 to Ondracek. REL00047548-REL00047630.
USTO for USP 6,450,265 to Ponte. REL00047631-REL00047739.
Underwriters Laboratories Inc. Directory, Fire Protection Equipment 1996, REL00047740-REL00047759.
The Reliable Automatic Sprinkler Co., Inc. Datasheet for Model G VELO Pendent Very Extra Large Orifice Sprinkler, Bulletin 146, Rev. E, Oct. 2009, REL00047760-REL00046671.
Viking Corp.; Technical Datasheet, "Model M Quick Response Extra-Large Orifice Sprinkler"; Jul. 16, 1998; 3 sheets. REL00047762-REL00047764.
Central Sprinkler Company, Datasheet for Central ELO-231 Storage Upright or Pendent Automatic Sprinkler K-Factor=11.4, No. 2-9.-0, 1994. REL00047765-REL00047768.
Sprinkler Photos, 1 page REL00047769.
Sprinkler Photos, 3 pages REL00047770-REL00047773.
Sprinkler Photos, 3 pages REL00048267-REL00048269.
Plaintiff Tyco—Second Amended Complaint, (13 pages) (Oct. 4, 2010).
Defendant Reliable—Reliable's Answer, Affirmative Defenses, and Counterclaims in Response to Plaintiff's Second Amended Complaint, (13 pages) (Oct. 29, 2010).
Plaintiff Tyco—Answer to Counterclaims, (3 pages) (Nov. 22, 2010).
Defendant Reliable—Reliable's Response to Tyco's First Set of Interrogatories (Nos. 1-4), (8 pages), (Jan. 7, 2011).
Plaintiff Tyco—Plaintiffs List of Terms and Proposed Constructions, (4 pages), (Feb. 8, 2011).
Defendant Reliable—Reliable's Prelimininary List of Claim Terms to be Construed by the Court and Proposed Constructions, (10 pages), (Feb. 8, 2011).
Defendant Reliable—Reliable's Supplemental Response to Tyco's First Set of Interrogatories plus Exhibits A-E, (77 pages), (Mar. 15, 2011).
Plaintiff Tyco—Plaintiff's Memorandum in Support of Its Proposed Claim Construction, (24 pages), (Mar. 17, 2011).
Defendant Reliable—Reliable's Opening Claim Construction Brief, (73 pages), (Mar. 17, 2011).
Defendant Reliable—Reliable's Response to Tyco's Second Set of Interrogatories, (4 pages), (Mar. 30, 2011).
Plaintiff Tyco—Plaintiffs Memorandum in Response to Reliable's Opening Claim Construction Brief, (61 pages), (Apr. 14, 2011).
Defendant Reliable—Reliable's Responsive Claim Construction Brief, (23 pages), (Apr. 14, 2011).
Defendant Reliable—Reliable's Response to Tyco's Third Set of Interrogatories (Nos. 6-8), (8 pages), (May 27, 2011).
"Duraspeed Sprinkler—Rack Storage—Q-17;" Sprinklers, Nozzles and Accessories/Section 4; Grinnell Fire Protection Systems Company, Inc.; Bulletin No. 211; Jan. 1975; 2 p.
"Approval Standard for Early Suppression-Fast Response (ESFR) Automatic Sprinklers;" Class No. 2008; Aug. 1996; Factory Mutual Research Corporation; pp. 1-47.
"Installation of Sprinkler Systems;" NFPA 13; 1999 Edition; National Fire Protection Association.

(56) References Cited

OTHER PUBLICATIONS

"Approval Standard for Automatic Sprinklers for Fire Protection;" Class Series 2000; May 1998; Factory mutual Corporation; pp. 1-90.
"Application of the Tyco Fire Products;" Sep. 2007, 21 pages, Tyco Fire & Building Products [online] [retrieved Oct. 30, 2007 from the Internet: URL<http://www.tyco-fire.
Color photocopies of three color photographs of Grinnell Quaterzoid—Issue D, Pagoda Q-5 Sprinkler with Rectangular Deflector, Nov. 13, 1967, (3 pages).
Defendant Reliable—Reliable's Supplemental Response to Tyco's First Set of Interrogatories (Nos. 1-2) plus Supplemental Invalidity Charts—Exhibits L1 and L2 (164 pages), (Aug. 5, 2011).
Defendant Reliable—Reliable's Amended Response to Tyco's First Set of Interrogatories (Nos. 1-4) plus Supplemental Invalidity Charts—Exhibits L1 and L2 153 pages), (Oct. 5, 2011).
Grinnell Corporation—Extended Coverage Ordinary Hazard Sprinklers Pendent, Recessed Pendent, and Upright—Model F895 Designer, 5/8" Orifice (K-11.4) and 3/4" Orifice (K=14.5.), Jun. 1997, 6 pages (REL00048575-REL00048580).
National Fire Protection Association, "Installation of Sprinkler Systems", NFPA 13, 1999 Edition.
Plaintiff Tyco Fire Products, Response to Office Action, U.S. Appl. No. 11/240,383, now USP 7,584,802, May 28, 2008, 26 pages, (TFP140664-TFP140689).
Defendant Reliable—Prior Art References Produced at REL00039117-REL00039535.
Defendant Reliable—Prior Art References Produced at REL000411194-REL00048269.
Defendant Reliable—Prior Art References Produced at REL00048278-REL00048566.
Reliable's Datasheet for Model N252 EC Pendent and Recessed Pendent Extended Coverage Area Density Sprinklers for Storage and Extra Hazard Applications, Bulletin 008, Rev. C, Jul. 2010, 4 pages.
Reliable's Datasheet for Model N252 EC Pendent for Control Mode Specific Application, Bulletin 908, Rev. B, Sep. 2010, 4 pages.

LOW PRESSURE, EXTENDED COVERAGE, FIRE PROTECTION SPRINKLER

TECHNICAL FIELD

This invention relates to fire protection sprinklers, and more particularly to upright-type fire protection sprinklers for extended coverage applications.

BACKGROUND

The present National Fire Protection Association (NFPA) standard governing minimum requirements for design and installation of automatic fire sprinkler systems is the 1999 Edition of NFPA 13 entitled "Standard for the Installation of Sprinkler Systems," the complete disclosure of which is incorporated herein by reference. According to the National Fire Protection Association, NFPA 13 was first issued in 1896 under direction of the NFPA Committee on Automatic Sprinklers. The standard is periodically revised and updated as new information and technology become available.

The 1999 Edition of NFPA 13 recognizes various classes of occupancies, termed: "Light Hazard," "Ordinary Hazard," "Extra Hazard," and "Special Occupancy Hazard," as well as various types of storage commodity classes, including: "Miscellaneous Storage" and "High-Piled Storage," the latter being categorized as including solid-piled, palletized, rack storage, bin box, and shelf storage in excess of twelve feet in height. NFPA 13 specifies the various levels of protection requirements for automatic fire sprinkler systems in these different types of occupancies, based, e.g., on severity of the potential fire hazard.

As generally defined by NFPA 13, Light Hazard occupancies are those where the quantity and/or combustibility of contents are low and fires with relatively low rates of heat release are expected. Ordinary Hazard covers those occupancies where the quantity and/or combustibility of the contents is equal to or greater than that of Light Hazard, ranging from low to high, where the quantity of combustibles is moderate and stock piles do not exceed twelve feet, such that fires with moderate to high rates of heat release are expected. Extra Hazard occupancies are those where quantity and combustibility of the contents are very high, and flammable or combustible liquids, dust, lint or other materials are present, such that the probability of rapidly developing fires with high rates of heat release is very high.

NFPA 13 does not specifically define Miscellaneous Storage and High-Piled Storage occupancies in terms of quantity and combustibility of material contents. Rather, it specifies various levels of fire protection requirements based on the type (combustibility) of materials (e.g., metal, paper, wood, plastics, rubber, etc.), amount of material, height of storage, and clearance between the top of the storage and the ceiling, as well as how the materials are stored (e.g., palletized, rack storage, solid-piled, etc.) and the method of packaging (e.g., cartoned. uncartoned, encapsulated, etc.).

NFPA 13 specifies maximum areas of protection per sprinkler for the various hazard occupancies. For example, in the case of a hydraulically calculated standard spray upright or pendent sprinkler system, the maximum protection area per sprinkler is: 225 square feet for a Light Hazard application with unobstructed ceiling construction; 130 square feet for an Ordinary Hazard application with all types of approved ceiling construction; and 100 square feet for Extra Hazard and High-Piled Storage applications with a water discharge density requirement equal to or greater than 0.25 gallon per minute per square foot, for any type of approved ceiling construction. The maximum area of protection per sprinkler for Miscellaneous Storage is determined by its Ordinary Hazard or Extra Hazard classification. This invention is specifically directed to protection of at least Extra Hazard and High-Piled Storage occupancies.

NFPA 13 also defines the protection area of a sprinkler as being at least rectangular (it may be square) and equal to:

$$S \times L$$

where:

S represents the greater of the distance from the sprinkler in question to the farthest spaced, immediately adjoining sprinkler, upstream or downstream, on the same supply line, or twice the distance from the sprinkler in question to a wall where the sprinkler in question is the last sprinkler on a supply line extending in a direction towards the wall, and L represents the greater of the perpendicular distance to the farthest spaced branch line immediately adjoining either lateral side of the branch line supporting the sprinkler in question, or twice the perpendicular distance to the farthest spaced wall immediately adjoining either side of the branch line which supports the sprinkler in question and which lacks an immediately adjoining branch line between it and the wall.

For example, in the case of a hydraulically calculated standard spray upright or pendent sprinkler system, the maximum spacing between sprinklers is: 15 feet for a Light Hazard application with unobstructed ceiling construction and for an Ordinary Hazard application with all types of approved ceiling construction; and 12 feet for Extra Hazard and High-Piled Storage applications with the water discharge requirement being equal to or greater than 0.25 gallon per minute per square foot.

A standard spray sprinkler, in either an upright or pendent deflector configuration, discharges a hemispherical-like pattern below the sprinkler deflector. Standard spray sprinklers are defined by Underwriters Laboratories Inc. ("UL") as having a nominal K Factor in the range from 1.4 to 11.2 where:

$$Q=K\sqrt{P}$$

where:

P represents the pressure of water fed into the inlet end of the internal passageway through the body of the sprinkler, in pounds per square inch gauge (psig); Q represents the flow of water from the outlet end of the internal passageway through the body of the sprinkler, in gallons per minute (gpm); and K represents the nominal K-factor constant in units of gallons per minute divided by the square root of pressure expressed in psig.

The maximum allowable spacing and minimum water discharge requirements for standard spray upright and pendent sprinklers are prescribed by NFPA 13 based on fire tests suitable to the selected hazard performed on like type sprinklers. Consequently, Listing agencies such as Underwriters Laboratories Inc. evaluate standard spray upright and pendent sprinklers to a set series of sprinkler performance tests at established spacing and water discharge values, to validate that the sprinklers will be suitable for use in applications prescribed in NFPA 13.

By comparison, extended coverage sprinklers, which are considered by NFPA 13 to be a type of Special Sprinkler and intended for the protection of areas greater than those for standard spray sprinklers, for an equivalent hazard, must be evaluated in a series of fire tests related to the intended hazard, at maximum sprinkler spacing and minimum water discharge requirements specified by the manufacturer. These fire tests established by the Listing agency (e.g., UL) are in addition to whatever water distribution, thermo-sensitivity, mechanical property, and environmental resistance tests are deemed appropriate, and which would also be applied to standard spray upright and pendent sprinklers.

In 1973, Section 4-1.1.1.3 was adopted and incorporated into NFPA 13, stating: "Special sprinklers may be installed with larger protection areas or distance between sprinklers than are specified in sections 4-2 and 4-5 when installed in accordance with the approvals or listing of a testing laboratory." At the time, Sections 4-2 and 4-5 defined the maximum spacing and protection areas indicated above, for standard spray sprinklers.

In 1987 that section of NFPA 13 was amended to read: "Special sprinklers-installation of special sprinklers with protection areas, locations and distances between sprinklers differing from those specified . . . shall be permitted when found suitable for such use based on fire tests related to hazard category, tests to evaluate distribution, wetting of floors and walls, and interference to distribution by structural elements and tests to characterize response to sensitivity."

Underwriters Laboratories, Inc. is the independent laboratory most widely utilized in the United States for testing and listing of fire protection sprinklers and it was the first to list Special Sprinklers. The main UL sprinkler test standard for sprinklers conforming to NFPA 13 is UL 199, entitled "Standard for Automatic Sprinklers for Fire-Protection Service."

Prior to the inventions described in Meyer et al. U.S. Pat. No. 5,366,022, issued Nov. 22, 1994, and the inventions described in subsequent related patents, including: Meyer et al. U.S. Pat. No. 5,579,846, issued Dec. 3, 1996; Meyer et al. U.S. Pat. No. 5,584,344, issued Dec. 17, 1996; Meyer et al. U.S. Pat. No. 5,609,211, issued Mar. 11, 1997; and Meyer et al. U.S. Pat. No. 5,644,630, issued Sep. 9, 1997; UL had only listed extended coverage types of Special Sprinklers for use in Light Hazard applications. Commercial embodiments of the above patents to Meyer et al. were extended coverage sprinklers with nominal K-factors of 11.2 and 14.0 for use in Ordinary Hazard applications.

The listing of upright and pendent, extended coverage type Special Sprinklers for use in Extra Hazard and High-Piled Storage applications was permitted under provisions of the 1973 through 1994 Editions of NFPA 13, although these editions of NFPA 13 did not include any installation guidance requirements specific to use of extended coverage type Special Sprinklers in Extra Hazard and High-Piled Storage applications. In anticipation of future expansion of Listings in these categories, in the 1996 Edition of NFPA 13, the NFPA incorporated maximum protection area and maximum spacing criteria for extended coverage upright and pendent spray sprinklers, as a function of ceiling construction type. Although the 1996 Edition of NFPA 13 did not provide performance requirements specific to the concept of extended coverage upright and pendent spray sprinklers for Extra Hazard and High-Piled Storage applications, it did specify maximum protection area of 196 square feet and maximum spacing of 14 feet for these applications. This was a reduction from the 400 square feet maximum protection area and 20 foot maximum spacing criteria previously applied to any type Special Sprinkler, due to concern that, in Extra Hazard and High-Piled Storage applications, a larger protection area and spacing might overtax adjacent sprinklers, should one sprinkler not operate as anticipated.

In preparation for the NFPA Annual Meeting held on May 20-23, 1996, during which time the 1996 Edition of NFPA 13 was acted upon, the NFPA issued a "Report on Comments." The "Report on Comments," which members were asked to bring to the Annual Meeting, was a compilation of NFPA Technical Committee Reports or Comments provided for review by the NFPA membership prior to consideration at the meeting. The "Report on Comments" included description of action taken by the Committee on Automatic Sprinklers on a proposal by Mr. Peter Thomas of The Viking Corporation concerning the table on Sprinkler Discharge Characteristics Identification (Table 2-2.2 in 1996 Edition, changed to Table 3-2.3.1 in the 1999 Edition of NFPA 13). Mr. Thomas proposed that reference to a nominal 17 K-factor sprinkler should not be included in the Table, since it was not required for use with either standard or extended coverage sprinkler spacing, and that nominal 22 K-factor and 30 K-factor sprinklers would be preferred for extended coverage Extra Hazard and, possibly, for High-Piled Storage occupancies. However, the Thomas proposal did not consider, or reference, thermal sensitivity characteristics of the heat-responsive trigger of nominal 22 K-factor or 30 K-factor sprinklers, which would be essential to determining suitability of sprinklers for use as extended coverage upright and pendent spray sprinklers protecting Extra Hazard and High-Piled Storage occupancies in accordance with the 1999 Edition of NFPA 13.

Although guidelines for installation of extended coverage upright and pendent spray sprinklers in Extra Hazard and High-Piled Storage occupancies were included in the 1996 Edition of NFPA 13, prior to the present invention, neither Underwriters Laboratories Inc. (UL) Standard UL199, entitled "Standard for Automatic Sprinklers for Fire-Protection Service," nor Factory Mutual Research Corporation (FM) Standard Class Series 2000, entitled "Approval Standard for Automatic Sprinklers for Fire Protection," contained any reference to listing and/or approval requirements for use of extended coverage upright and pendent spray sprinklers in Extra Hazard and High-Piled Storage occupancies, even though both documents contained explicit listing and/or approval test requirements for use of extended coverage upright and pendent spray sprinklers in Light Hazard and Ordinary Hazard occupancies.

Furthermore, Meyer et al. U.S. Pat. No. 5,366,022, and the subsequent related patents listed above, suggested that the heat-responsive trigger in extended coverage sprinklers for use in Light Hazard and Ordinary Hazard occupancies should provide the quickest possible response times, in order to activate the sprinkler as soon as possible after the beginning of a fire. Meyer et al. further suggested that the response time index (RTI) of the heat-responsive trigger should be less than 100 $meter^{1/2}sec^{1/2}$ ($m^{1/2}s^{1/2}$) and preferably less than 50 $meter^{1/2}sec^{1/2}$ ($m^{1/2}s^{1/2}$). Also, the Meyer et al. patents teach that sprinklers with a K-factor greater than 8.7 are preferred for extended coverage sprinklers for use in Light Hazard and Ordinary Hazard occupancies, in order to minimize the water pressure required at the inlet end of the internal passageway through the body of the sprinkler, and thereby to reduce possible need for a booster pump in the sprinkler system water supply to establish adequate pressure for water fed into the inlet ends of the sprinklers.

SUMMARY OF THE INVENTION

According to one aspect of the invention, a low pressure (e.g., 7 psig minimum), extended coverage, fire protection sprinkler, suitable for use in protection of at least extra hazard and high piled storage occupancies, in accordance with the 1999 Edition of NFPA 13, comprises a body defining an internal passageway extending between an inlet end and an opposite outlet end, the internal passageway having a K-factor of greater than about 16.0, where K-factor equals average flow of water in gallons per minute through the internal passageway divided by square root of pressure of water fed into the inlet end of the internal passageway in pounds per square inch gauge, the outlet end having an axis; a deflector mounted to the body by at least one support arm extending from the body and in alignment with the axis and spaced from the outlet end of the internal passageway, at a position with an inner surface of the deflector opposed to flow of water from the outlet end of the internal passageway, the inner surface of the deflector being configured and arranged to deflect flow of water generally radially outwardly and downwardly of the sprinkler; and a thermally-responsive closure assembly mounted in a manner to secure the outlet end of the internal passageway against flow of water in a non-fire condition and to release in response to a predetermined temperature condition indicative of a tire to permit flow of water from the outlet end of the internal passageway, the thermally-responsive closure assembly comprising a closure element and a heat-responsive trigger mounted to releasably secure the closure element at the outlet end of the internal passageway, the heat-responsive trigger having a response time index of at least about 15 meter$^{1/2}$sec$^{1/2}$ (m$^{1/2}$s$^{1/2}$) and less than about 120 meter$^{1/2}$sec$^{1/2}$ (m$^{1/2}$s$^{1/2}$).

According to another aspect of the invention, a low pressure, extended coverage, upright-type fire protection sprinkler, suitable for use in protection of at least extra hazard and high piled storage occupancies, in accordance with the 1999 Edition of NFPA 13, comprises a body defining an internal passageway extending between an inlet end and an opposite outlet end, the internal passageway having a K-factor of greater than about 16.0, where K-factor equals average flow of water in gallons per minute through the internal passageway divided by square root of pressure of water fed into the inlet end of the internal passageway in pounds per square inch gauge, the outlet end having an axis; a deflector mounted to the body by at least one support arm extending from the body and disposed in alignment with the axis and generally above and spaced from the outlet end of the internal passageway, at a position with an inner surface of the deflector opposed to flow of water from the outlet end of the internal passageway, the inner surface of the deflector being configured and arranged to deflect flow of water generally radially outwardly and downwardly of the sprinkler; and a thermally-responsive closure assembly mounted in a manner to secure the outlet end of the internal passageway against flow of water in a non-fire condition and to release in response to a predetermined temperature condition indicative of a fire to permit flow of water from the outlet end of the internal passageway, the thermally-responsive closure assembly comprising a closure element and a heat-responsive trigger mounted to releasably secure the closure element at the outlet end of the internal passageway, the heat-responsive trigger having a response time index (RTI) of at least about 15 meter$^{1/2}$sec$^{1/2}$ (m$^{1/2}$s$^{1/2}$) and less than about 120 meter$^{1/2}$sec$^{1/2}$ (m$^{1/2}$s$^{1/2}$).

Preferred embodiments of these aspects of the invention may include one or more the following additional features. The response time index (RTI) is at least about 15 meter$^{1/2}$ sec$^{1/2}$ (m$^{1/2}$s$^{1/2}$) and less than about 50 meter$^{1/2}$sec$^{1/2}$ (m$^{1/2}$s$^{1/2}$), preferably the RTI is at least about 15 meter$^{1/2}$sec$^{1/2}$ (m$^{1/2}$s$^{1/2}$) and less than about 35 meter$^{1/2}$sec$^{1/2}$ (m$^{1/2}$s$^{1/2}$), and more preferably the RTI is about 23 meter$^{1/2}$sec$^{1/2}$(m$^{1/2}$s$^{1/2}$). The K-factor is between about 18 and about 41, preferably between about 21 and about 35, more preferably between about 23 and about 27, and still more preferably the K-factor is about 25.2. The heat-responsive trigger comprises a fusible solder element, preferably with a response time index (RTI) less than about 50 meter$^{1/2}$ sec$^{1/2}$ (m$^{1/2}$s$^{1/2}$), and more preferably less than about 35 meter$^{1/2}$ sec$^{1/2}$ (m$^{1/2}$s$^{1/2}$). Also, preferably, the heat-responsive trigger has a nominal release temperature of about 155° F. or above. The sprinkler is disposed in an array, with a first sprinkler spaced apart from an adjacent sprinkler in the array at a minimum distance of about 10 feet from the axis, in a first direction generally perpendicular to a plane generally of at least one support arm and the axis, and in a second direction generally coplanar with the plane generally of at least one support arm and the axis, whereby the first sprinkler has a rectangular fire protection area of about 100 square feet. The sprinkler is disposed in an array, with a first sprinkler spaced apart from an adjacent sprinkler in the array at a distance of about 14 feet from the axis, in a first direction generally perpendicular to a plane generally of at least one support arm and the axis, and in a second direction generally coplanar with the plane generally of at least one support arm and the axis, whereby the first sprinkler has a rectangular fire protection area of about 196 square feet. The pressure of water fed into the inlet end of the internal passageway is in the range of about 7 pounds per square inch to about 175 pounds per square inch. The sprinkler, disposed in an array of sprinklers, is suitable for use in protection of at least extra hazard and high piled storage occupancies, with the water supply requirements for the sprinklers being determined in accordance with the area/density calculation methods of the 1999 Edition of NFPA 13. The sprinkler, disposed in an array of sprinklers, is suitable for use in protection of at least extra hazard and high-piled storage occupancies, with the water supply requirements for the sprinklers being determined in accordance with the area/density calculation methods of the 1999 Edition of NFPA 13 for an area of sprinkler operation of about 2400 square feet or less, and preferably about 2000 square feet. The inner surface of the deflector defines a generally planar central area intersecting and generally perpendicular to the axis, a redirecting area comprising four slanted redirecting surfaces extending from a radially outer peripheral edge of the central area, each at a predetermined acute angle, relative to a horizontal plane through the central area, with a radially outer perimeter of the slanted redirecting surfaces being axially relatively closer to the outlet than the central area, and a plurality of spaced-apart tines extending from the radially outer perimeter of the slanted redirecting surfaces, towards the outlet, at predetermined tine angles, measured relative to the axis, with the intersections of adjacent slanted redirecting surfaces of the inner surface of the deflector defining channels, the channels extending radially outwardly and downwardly of the central area to enlarged, scalloped openings defined by adjacent of the spaced-apart tines at corner regions of the radially outer perimeter of the slanted redirecting surfaces with centers of the channels disposed at about 45° to a plane generally of at least one support arm and the axis, thereby to direct a relatively lengthened flow of water toward the corner regions of the predetermined spray pattern disposed at about 45° to the plane generally of at least one support arm and the axis.

According to still another aspect of the invention, an upright-type fire protection sprinkler comprises a body defining an internal passageway extending between an inlet end and an opposite outlet end, the internal passageway having a K-factor of greater than about 9.0, where K-factor equals average flow of water in gallons per minute through the internal passageway divided by square root of pressure of water fed into the inlet end of the internal passageway in pounds per square inch gauge, the outlet end having an axis; and a deflector mounted to body by at least one support arm extending from the body and disposed in alignment with the axis and generally above and spaced from the outlet end of the internal passageway, at a position with an inner surface of the deflector opposed to flow of water from the outlet end of the internal passageway, the inner surface of the deflector being configured and arranged to deflect flow of water generally radially outwardly and downwardly of the sprinkler; the inner surface of the deflector defines a generally planar central area intersecting and generally perpendicular to the axis, a redirecting area comprising a plurality of three or more slanted redirecting surfaces extending from a radially outer peripheral edge of the central area, each at a predetermined acute angle, relative to a horizontal plane through the central area, with the radially outer perimeter of the slanted redirecting surfaces being axially relatively closer to the outlet than the central area, and a plurality of spaced-apart tines extending from the radially outer perimeter of the slanted redirecting surfaces, towards the outlet, at predetermined tine angles, measured relative to the axes.

Preferred embodiments of this aspect of the invention may include one or more the following additional features. The three or more slanted redirecting surfaces are substantially planar. Preferably, the redirecting area comprises four slanted redirecting surfaces, and. more preferably, each slanted redirecting surface is symmetrical about a vertical plane generally through its center, with an intersection of each vertical plane with the slanted redirecting surface defining the predetermined acute angle, measured relative to the horizontal plane through the central area. Preferably, the predetermined acute angle is between about 10° and about 40°, more preferably between about 15° and about 35°, and still more preferably between about 20° and about 30°.

According to one aspect of this preferred embodiment, the sprinkler is a low pressure, extended coverage, upright type fire protection sprinkler, suitable for use in protection of at least extra hazard and high piled storage occupancies, in accordance with the 1999 Edition of NFPA 13, and the internal passageway has a K-factor greater than about 16.0, more preferably the K-factor is about 25.2, and still more preferably the predetermined acute angle is about 20°. The deflector comprises two or more spaced-apart tines extending from the radially outer perimeter of each slanted redirecting surface towards the outlet. Preferably, the deflector comprises three or more spaced-apart tines extending from the radially outer perimeter of the slanted redirecting surface towards the outlet. More preferably, the deflector comprises five spaced-apart tines extending from the radially outer perimeter of the slanted redirecting surface towards the outlet. The predetermined tine angle of the two or more spaced-apart tines is between about 0° and about 25° and preferably between about 5° and about 20°. The predetermined tine angle of the three or more spaced-apart tines is between about 0° and about 25° and preferably between about 5° and about 20°. The predetermined tine angle of the five spaced-apart tines is between about 0° and about 25° and preferably between about 5° and about 20°. The five spaced-apart tines extending from the radially outer perimeter of the slanted redirecting surface towards the outlet are characterized by different predetermined tine angles. For example, three adjacent spaced-apart tines extending from a middle region of the slanted redirecting surface towards the outlet are characterized by a predetermined tine angle between about 3° and about 11°, and two other spaced-apart tines extending from opposite outer regions of the slanted redirecting surface towards the outlet are characterized by a predetermined tine angle between about 9° and about 17°. Preferably, the three adjacent spaced-apart tines extending from the middle region of the slanted redirecting surface towards the outlet are characterized by a predetermined tine angle of about 7°, and the two other spaced-apart tines extending from the opposite outer regions of the slanted redirecting surface towards the outlet are characterized by a predetermined tine angle of about 13°. The vertical plane through center regions of a first opposing pair of slanted redirecting surfaces is substantially perpendicular to a plane generally of at least one support arm and the axis. Preferably, the vertical plane through center regions of a second opposing pair of the slanted redirecting surfaces is substantially coplanar to a plane generally of at least one support arm and the axis. More preferably, the deflector comprises two or more spaced-apart tines extending from the radially outer perimeter of each of the first opposing pair of slanted redirecting surfaces and three or more spaced-apart tines extending from the radially outer perimeter of each of the second opposing pair of slanted redirecting surfaces. Preferably, the spaced-apart tines extending from each of the first opposing pair of slanted redirecting surfaces are characterized by a predetermined tine angle of between about 5° and about 20°, and the spaced-apart tines extending from each of the second opposing pair of slanted redirecting surfaces are characterized by a predetermined tine angle of between about 5° and about 20°.

According to another aspect of the invention, a low pressure (e.g., 7 psig minimum), extended coverage, upright-type fire protection sprinkler, suitable for use in protection of at least extra hazard and high piled storage occupancies, in accordance with the 1999 Edition of NFPA 13, comprises a body defining an internal passageway extending between an inlet end and an opposite outlet end, the internal passageway having a K-factor of greater than about 16.0, where K-factor equals average flow of water in gallons per minute through the internal passageway divided by square root of pressure of water fed into the inlet end of the internal passageway in pounds per square inch gauge, the outlet end having an axis; and a deflector mounted to the body by at least one support arm extending from the body and disposed in alignment with the axis and generally above and spaced from the outlet end of the internal passageway, at a position with an inner surface of the deflector opposed to flow of water from the outlet end of the internal passageway, the inner surface of the deflector being configured and arranged to deflect flow of water generally radially outwardly and downwardly of the sprinkler in a predetermined spray pattern of generally polygonal shape when viewed at a distance of about 3 feet below the deflector and at a pressure of about 12 psig at the inlet end of the internal passageway.

Preferred embodiments of this aspect of the invention may include one or more the following additional features. The polygonal shape spray pattern approximates a rectangular shape with the centerline through one set of opposing sides of the rectangular shape being substantially perpendicular to a plane generally of at least one support arm and the axis. Preferably, the rectangular shape has minimum dimensions of about 6 feet on a side.

According to still another aspect of the invention, a low pressure (e.g., 7 psig minimum), extended coverage, upright-type fire protection sprinkler, suitable for use in protection of at least extra hazard and high piled storage occupancies, in accordance with the 1999 Edition of NFPA 13, comprises a body defining an internal passageway extending between an inlet end and an opposite outlet end, the internal passageway having a K-factor of greater than about 16.0, where K-factor equals average flow of water in gallons per minute through the internal passageway divided by square root of pressure of water fed into the inlet end of the internal passageway in pounds per square inch gauge, the outlet end having an axis, and a deflector mounted to the body by at least one support arm extending from the body and disposed in alignment with the axis and generally above and spaced from the outlet end of the internal passageway, at a position with an inner surface of the deflector opposed to flow of water from the outlet end of the internal passageway, the inner surface of the deflector being configured and arranged to deflect flow of water generally radially outwardly and downwardly of the. sprinkler in a predetermined spray pattern such that water collects at a minimum rate of about 0.15 gallon per minute per square foot in a one foot by one foot area centered at about a 9 foot radius from the axis in any direction at about 45° to a plane generally of at least one support arm and the axis at a distance of about 4 feet below the deflector and at a pressure of about 16 psig at the inlet end of the internal passageway.

In a preferred embodiment of this aspect of the invention, the minimum rate of water collected in the one foot by one foot area centered at the 9 foot radius from the axis in any direction at about 45° to a plane generally of at least one support arm and the axis at the distance of about 4 feet below the deflector and at the pressure of about 16 prig at the inlet end of the internal passageway is about 0.20 gallon per minute per square foot.

According to still another aspect of the invention, a low pressure, extended coverage, upright-type fire protection sprinkler, suitable for use in protection of at least extra hazard and high piled storage occupancies, in accordance with the 1999 Edition of NFPA 13, comprises a body defining an internal passageway extending between an inlet end and an opposite outlet end, the internal passageway having a K-factor of greater than about 16.0, where K-factor equals average flow of water in gallons per minute through the internal passageway divided by square root of pressure of water fed into the inlet end of the internal passageway in pounds per square inch gauge, the outlet end having an axis; and a deflector mounted to the body by at least one support arm extending from the body and disposed in alignment with the axis and generally above and spaced from the outlet end of the internal passageway, at a position with an inner surface of the deflector opposed to flow of water from the outlet end of the internal passageway, the inner surface of the deflector being configured and arranged to deflect flow of water generally radially outwardly and downwardly of the sprinkler in a predetermined spray pattern such that more water is collected in a one foot by one foot area centered at about an 8 foot radius from the axis in any direction at about 45 to a plane generally of at least one support arm and the axis, than in either the direction of the plane generally of at least one support arm and the axis, or in a direction perpendicular to the plane generally of at least one support arm and the axis, at a distance of about 3 feet below the deflector and at a pressure of about 16 psig at the inlet end of the internal passageway.

According to another aspect of the invention, a low pressure, extended coverage, upright-type fire protection sprinkler, suitable for use in protection of at least extra hazard and high piled storage occupancies, in accordance with the 1999 Edition of NFPA 13, comprises a body defining an internal passageway extending between an inlet end and an opposite outlet end, the internal passageway having a K-factor of greater than about 16.0, where K-factor equals average flow of water in gallons per minute through the internal passageway divided by square root of pressure of water fed into the inlet end of the internal passageway in pounds per square inch gauge, the outlet end having an axis; and a deflector mounted to the body by at least one support arm extending from the body and disposed in alignment with the axis and generally above and spaced from the outlet end of the internal passageway, at a position with an inner surface of the deflector opposed to flow of water from the outlet end of the internal passageway, the inner surface of the deflector being configured and arranged to deflect flow of water generally radially outwardly and downwardly of the sprinkler in a predetermined spray pattern such that water collects at a minimum average rate of about 0.05 gallon per minute per square foot at a distance of about 10 feet below the deflector and at a pressure of about 16 psig at the inlet end of the passageway, in a 20 foot long array of one foot by one foot pans disposed parallel to a plane generally of at least one support arm and the axis, the longitudinal centerline of the foot long array of pans being horizontally offset 10 feet from either side of the plane generally of at least one support arm and the axis, and the lateral centerline of the 20 foot long array of pans being located along an orthogonal plane perpendicular to the plane generally of at least one support arm and the axis, and intersecting the axis.

According to yet another aspect of the invention, a low pressure, extended coverage, upright-type fire protection sprinkler, suitable for use in protection of at least extra hazard and high piled storage occupancies, in accordance with the 1999 Edition of NFPA 13, comprises a body defining an internal passageway extending between an inlet end and an opposite outlet end, the internal passageway having a K-factor of greater than about 16.0, where K-factor equals average flow of water in gallons per minute through the internal passageway divided by square root of pressure of water fed into the inlet end of the internal passageway in pounds per square inch gauge, the outlet end having an axis; and a deflector mounted to the body by at least one support arm extending from the body and disposed in alignment with the axis and generally above and spaced from the outlet end of the internal passageway, at a position with an inner surface of the deflector opposed to flow of water from the outlet end of the internal passageway, the inner surface of the deflector being configured and arranged to deflect flow of water generally radially outwardly and downwardly of the sprinkler in a predetermined spray pattern such that water collects at a minimum average rate of about 0.07 gallon per minute per square foot at a distance of about 10 feet below the deflector and at a pressure of about 16 psig at the inlet end of the passageway, in a 20 foot long array of one foot by one foot pans disposed parallel to a plane generally of at least one support arm and the axis, the longitudinal centerline of the foot long array of pans—being horizontally offset 10 feet from either side of the plane generally of at least one support arm and the axis, and the lateral centerline of the 20 foot long array of pans being located along an orthogonal plane perpendicular to the plane generally of at least one support arm and the axis, and intersecting the axis.

According to still another aspect of the invention, a low pressure, extended coverage, upright-type fire protection sprinkler, suitable for use in protection of at least extra hazard and high piled storage occupancies, in accordance with the 1999 Edition of NFPA 13, comprises a body defining an internal passageway extending between an inlet end and an opposite outlet end, the internal passageway having a K-factor of greater than about 16.0, where K-factor equals average flow of water in gallons per minute through the internal passageway divided by square root of pressure of water fed into the inlet end of the internal passageway in pounds per square inch gauge, the outlet end having an axis; and deflector mounted to the body by at least one support arm extending from the body and disposed in alignment with the axis and generally above and spaced from the outlet end of the internal passageway, at a position with an inner surface of the deflector opposed to flow of water from the outlet end of the internal passageway, the inner surface of the deflector being configured and arranged to deflect flow of water generally radially outwardly and downwardly of the sprinkler in a predetermined spray pattern such that water collects at a minimum average rate of about 0.09 gallon per minute per square foot at a distance of about 10 feet below the deflector and at a pressure of about 16 psig at the inlet end of the passageway, in a 20 foot long array of one foot by one foot pans disposed parallel to a plane generally of at least one support arm and the axis, the longitudinal centerline of the foot long array of pans being horizontally offset 10 feet from either side of the plane generally of at least one support arm and the axis, and the lateral centerline of the 20 foot long array of pans being located along an orthogonal plane perpendicular to the plane generally of at least one support arm and the axis, and intersecting the axis.

A fire protection sprinkler can be characterized by its discharge coefficient or K-factor, which equals average flow of water in gallons per minute through the internal passageway of the sprinkler divided by square root of the pressure of water fed into the inlet end of the internal passageway in pounds per square inch gauge. The discharge coefficient is governed to a large degree by the smallest cross sectional area of the internal passageway, in combination with the contour of the internal passageway. Discharge coefficients or K-factors are described as "nominal" values. Typically, "nominal" K-factors are expressed in standard sizes. Section 3-2.3 of the 1999 Edition of NFPA 13 "Standard for the Installation of Sprinkler Systems," provides guidelines for allowable "nominal" K-factors as well as the range of individual K-factor values permitted over the range of allowable water pressures at the inlet end of the internal passageway of the sprinkler, from minimum to maximum. For example, a sprinkler with a nominal K-factor of 16.8 encompasses a range of allowable values from 16.0 to 17.6, while a sprinkler with a nominal K-factor of 25.2 encompasses a range of allowable values from 23.9 to 26.5.

Sprinkler response to a fire condition (activation) is a function of a number of parameters. These include: temperature rating of the sprinkler; thermal sensitivity of the heat-responsive trigger portion of the sprinkler thermally-responsive closure assembly; initial ambient temperature conditions; ceiling height above the burning fuel; horizontal distance from the sprinkler(s) to the vertical fire axis; vertical distance from the ceiling to the sprinkler heat-responsive trigger; ceiling configuration and compartmentalization factors: and the rate of heat release from the fire, as described in the Seventh Edition of the "Automatic Sprinkler Systems Handbook." edited by Milosh T. Puchovsky, P. E., the Response Time Index or "RTI" is a measure of thermal sensitivity as it relates to thermal inertia of the heat responsive trigger of an automatic sprinkler. RTI is substantially insensitive to the temperature rating of the sprinkler. The RTI value of a specific design for the heat-responsive trigger of an automatic sprinkler is determined experimentally by the use of a wind tunnel. The equation used for calculating RTI, and an apparatus and test procedure suitable for experimentally determining the parameters necessary to the calculation of RTI, are found, e.g., in the Factory Mutual Research Corporation "Approval Standard for Automatic Sprinklers for Fire Protection," Class Series 2000, dated May 1998, the complete disclosure of which is incorporated herein by reference. The 1999 Edition of NFPA 13 (referenced above) defines a sprinkler as being of the quick-response or fast-response type if its thermal sensitive element (i.e., heat-responsive trigger) has an RTI of 50 $meter^{1/2}sec^{1/2}$ ($m^{1/2}s^{1/2}$) or less, and a sprinkler is defined as being of the standard-response type if its thermal sensitive element has an RTI of 80 $meter^{1/2}sec^{1/2}$ ($m^{1/2}s^{1/2}$) or more.

The invention described herein, in an embodiment, termed a "25.2 K-factor Model EC-25" upright sprinkler, combines the attributes of a K-factor of greater than about 16 with a heat-responsive trigger having an RTI of at least about 15 $meter^{1/2}$ $sec^{1/2}$ ($m^{1/2}s^{1/2}$) and less than about 120 $meter^{1/2}$ $sec^{1/2}$ ($m^{1/2}s^{1/2}$) to provide an extended coverage-type Special Sprinkler suitable for use in protection of Extra Hazard and High-Piled Storage occupancies with a maximum protection area of up to 196 square feet and installation in accordance with applicable installation criteria of the 1999 Edition of NFPA 13, with low pressures (e.g., 7 psig minimum) at the inlet end of the internal passageway through the body of the sprinkler.

UL and the Factory Mutual Research Corporation (FM), an FM Global Affiliate, initiated consideration of qualification test programs necessary to establish suitability of any type of extended coverage sprinkler for use in protection of Extra Hazard and High-Piled Storage occupancies, with a maximum protection area per sprinkler of 196 square feet, only after they were specifically requested to establish Listing and/or Approval programs for the 25.2 K-factor Model EC-25 upright sprinkler. No Listing Agency, as defined by the 1999 Edition of NFPA 13 (e.g., UL and FM), has established a minimum RTI requirement for the heat-responsive, trigger of any type of automatic sprinkler for fire protection service.

Fires involving the types of commodities present in Extra Hazard and High-Piled Storage occupancies have relatively high rates of heat release. Therefore, a sufficiently thermally sensitive, heat-responsive trigger (i.e., having an RTI less than a specified value) is required so that, prior to activation of sprinkler(s) in closest proximity to the fire, the fire is restricted from growing to such a size that it could overwhelm the flow of water discharged over the fire area. If a fire is not so restricted, the heat wave from the fire could activate sprinklers outside the immediate fire area, thus depleting the supply of water available to fight the fire and, potentially, allowing the fire to grow in size with more sprinklers activating still further away from the immediate, initial fire area. However, the heat-responsive trigger of extended coverage type of Special Sprinklers of this invention must also be sufficiently thermally insensitive (i.e., having an RTI of at least a specified value), in order to reduce the possibility that heat-responsive elements of sprinklers outside the immediate fire area will be prematurely heated to an activation temperature, thus also depleting the supply of water available to fight the fire, as described above.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
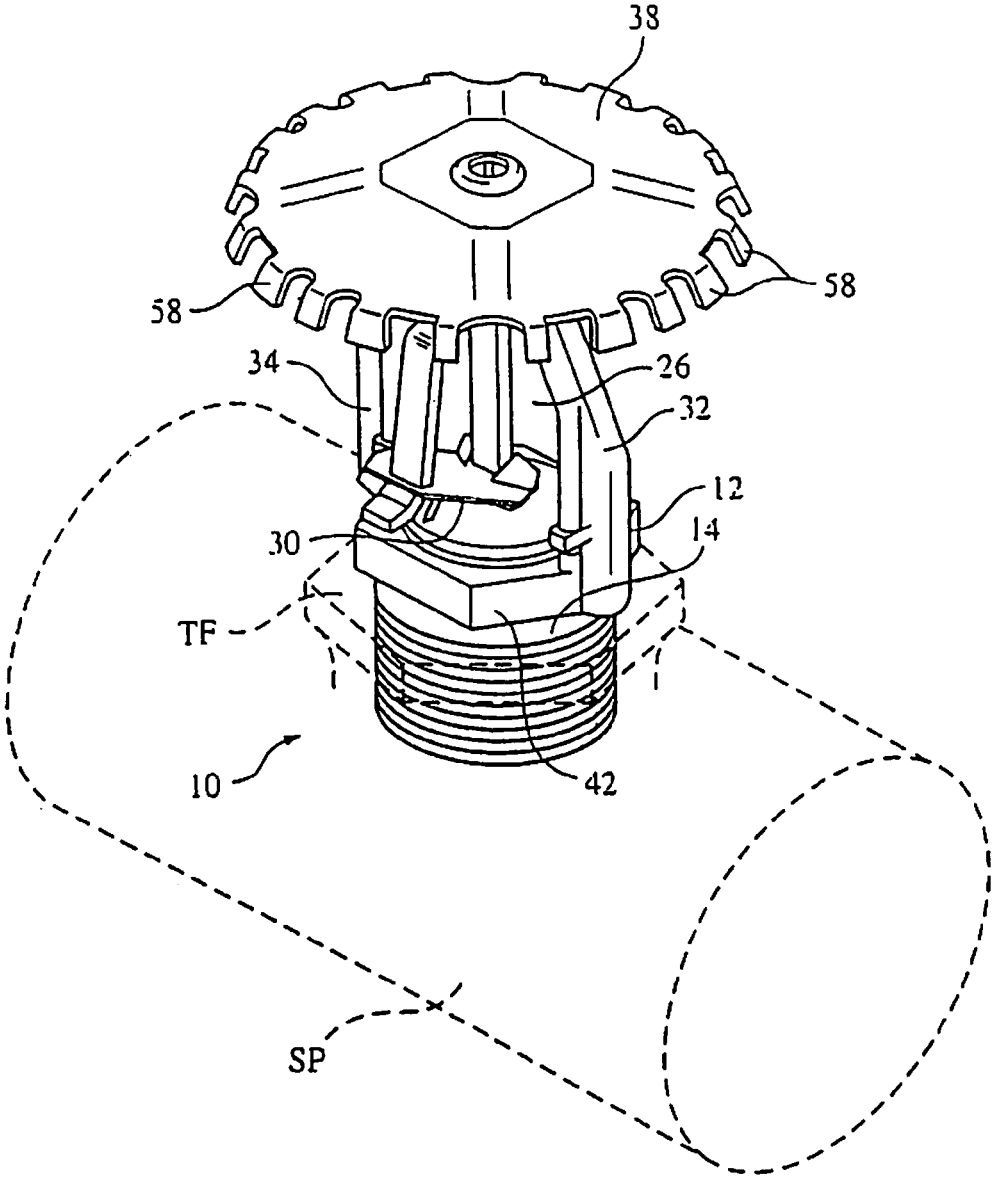
FIG. 1 is a perspective view of a low pressure, extended coverage, upright-type fire protection sprinkler of the invention.
Figure 2:
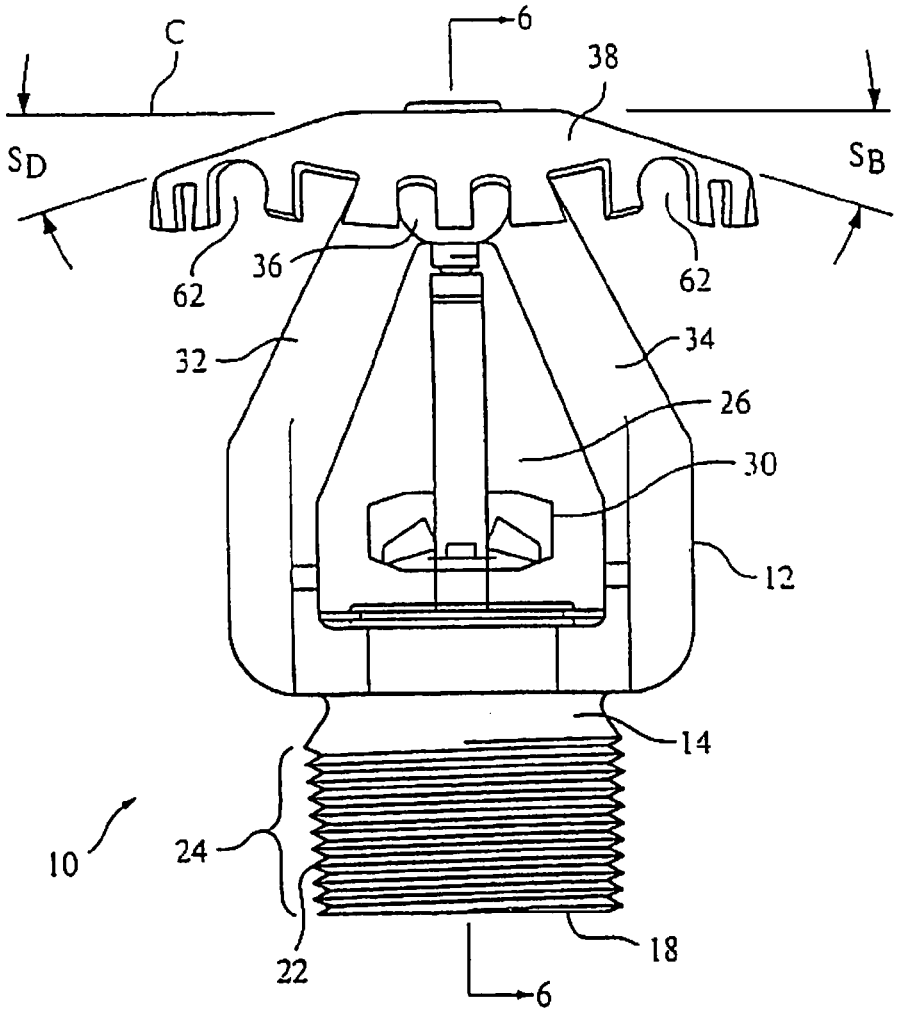
FIG. 2 is a front elevational view of the low pressure, extended coverage, upright, type fire protection sprinkler of FIG. 1.
Figure 3:
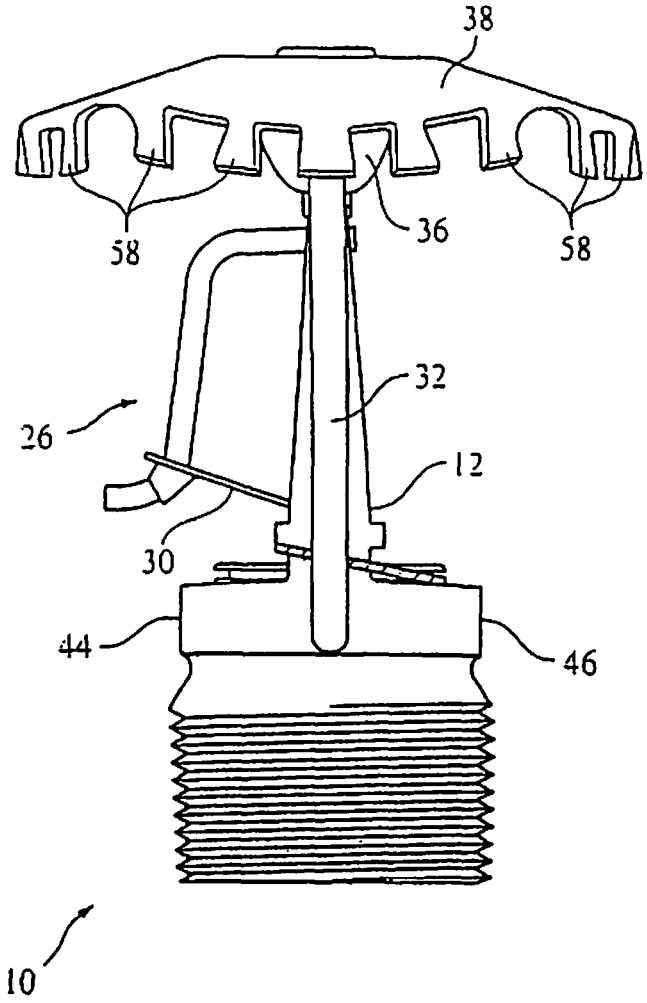
FIG. 3 is a side elevational view of the low pressure, extended coverage, upright-type fire protection sprinkler of FIG. 1.
Figure 4:
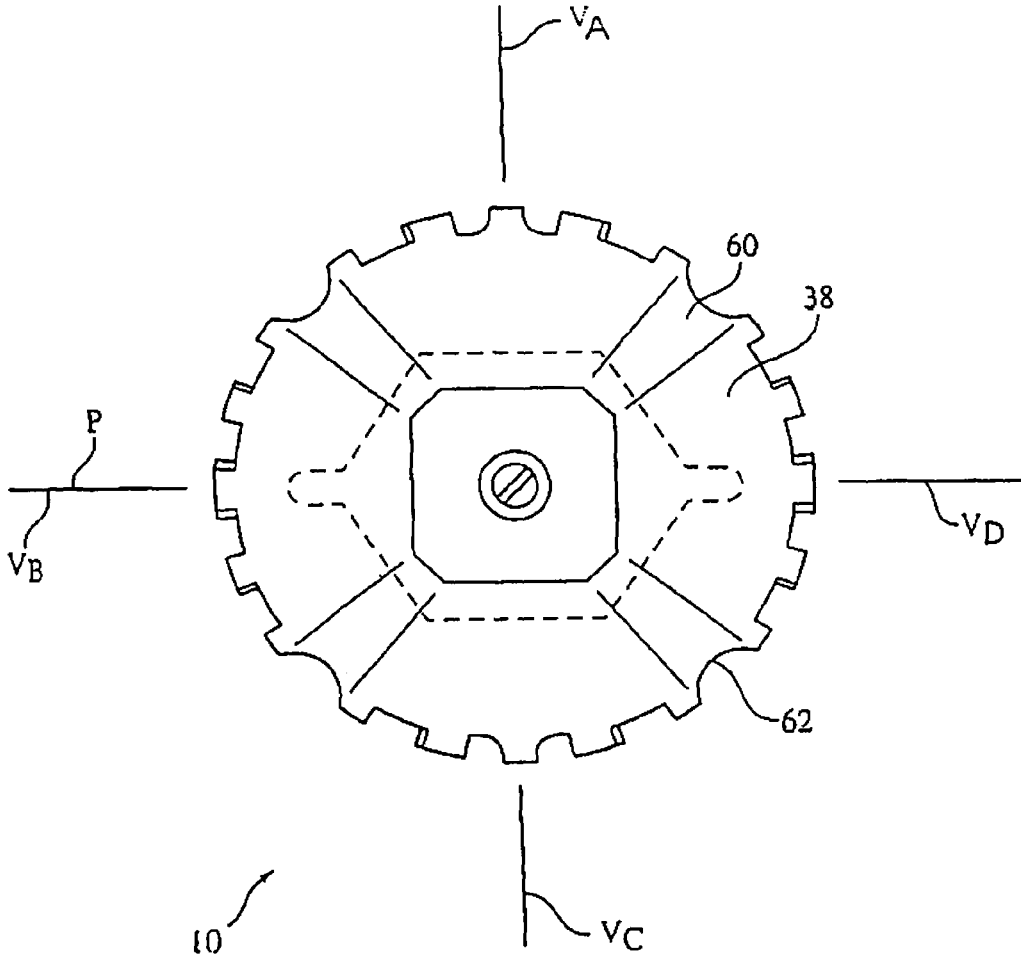
FIG. 4 is a top plan view of the low pressure, extended coverage, upright-type fire protection sprinkler of FIG. 1.

Referring to FIGS. 1-6, an upright-type fire protection sprinkler 10 of the invention includes a one-piece frame 12 having a body 14 defining an internal passageway 16 that extends between an inlet end 18 and an opposite outlet end 20. Cooperating threads 22 provided on the outside surface 24 of the body in the region of the inlet end 18 and in the internal passageway 16 permit the sprinkler 10 to be coupled to a threaded fitting, TF (shown in dashed line), adapted for connection to a supply pipe, SP (also shown in dashed line in FIG. 1), for delivery of water, or other fire fighting fluid. The outlet end 20 of internal passageway 16 has an axis, A.

The frame 12 further typically includes a pair of support arms 32, 34 extending generally away from opposite sides of the outlet end 20 of the body 14 and meeting to form an apex 36. The apex is aligned with axis, A, and positioned generally above and spaced from the outlet end 20 of the internal passageway. A deflector 38, supported by the apex 36, has an inner deflector surface 40 opposed to flow of fire-fighting fluid, e.g., water, from the outlet end 20 of the internal passageway 16, the inner deflector surface 40 being configured and arranged to deflect flow of fire-fighting fluid generally radially outwardly and downwardly of the sprinkler 10.

At the outlet end 20 of the body 14, the frame 12 is enlarged into a hexagonally shaped, circumferential flange 42, with major, opposite parallel flat surfaces or "flats" 44, 46. The flats are positioned for engagement with an open-ended wrench or a specially designed sprinkler wrench having a hexagonally shaped recess for threading and tightening the sprinkler 10 into the threaded fitting, TF, for connection to the supply pipe, SP.

In a standby or non-fire condition, e.g., as shown in FIGS. 1, 2, 3 and 6, a thermally-responsive closure assembly 26, having a closure element 28 and a heat-responsive trigger 30, is mounted to the sprinkler body 14 in a manner to releasably secure the outlet end 20 of the internal passageway 16 against flow of water. In response to a predetermined temperature condition indicative of a fire, the heat-responsive trigger 30 separates, releasing closure assembly 26, to permit flow of water from the supply pipe, SP, through the internal passageway 16, and out through the outlet end 20.

Referring again to FIGS. 1-6, the inner deflector surface 40 defines a generally planar central area 48, intersecting and generally perpendicular to the axis, A, and a redirecting area 50, consisting of a plurality, e.g., four are shown, of slanted, preferably planar, redirecting surfaces 52A, 52B, 52C, 52D. extending from a radially outer peripheral edge 54 of the central area 48. Each of the redirecting surfaces is slanted at a predetermined acute angle, $S_A$, $S_B$, $S_C$, $S_D$, relative to a horizontal plane, C, through the central area 48, and a radially outer perimeter 56 of the slanted redirecting surfaces 52A, 52B, 52C, 52D of the redirecting area 50 lies axially relatively closer to the outlet end 20 than the central area 48. A plurality of spaced-apart tines 58 extend from the radially outer perimeter 56 of the slanted redirecting surfaces 52A, 52B, 52C, 52D, towards the outlet end 20, at predetermined tine angles, T, measured relative to the axis, A. Each slanted redirecting surface 52A, 52B, 52C, 52D is symmetrical about a vertical plane, $V_A$, $V_B$, $V_C$, $V_D$, respectively, generally through its center and the axis, with an intersection of each vertical plane, $V_A$, $V_B$, $V_C$, $V_D$, with its respective slanted redirecting surface 52A, 52B, 52C, 52D defining the predetermined acute angle, $S_A$, $S_B$, $S_C$, $S_D$, measured relative to the horizontal plane, C, through the central area 48. In a preferred embodiment of a sprinkler 10 of the invention having a K-factor of at least about 9.0, the predetermined acute angle, $S_A$, $S_B$, $S_C$, $S_D$, is between about 10° and about 40°, preferably between about 15° and about 35°, and more preferably between about 20° and about 30°.

Referring still to FIGS. 1-6, in a preferred embodiment of the fire protection sprinkler 10, three or more of the spaced-apart tines 58 extend from each respective segment 56A, 56B, 56C, 56D of the radially outer perimeter 56 of each slanted redirecting surfaces 52A, 52B, 52C, 52D of the redirecting area 50, towards the outlet end 20, with predetermined tine angles, T, measured relative to the axis, of the spaced-apart tines 58 between about 0° and about 25°, and preferably between about 5° and about 20°. Preferably, four or more spaced apart tines 58 extend from the radially outer perimeter segments 56A, 56B, 56C, 56D of the slanted redirecting area 50 towards the outlet end 20, with predetermined tine angles, T, between about 0° and about 25°, and preferably between about 5° and about 20°. More preferably, five spaced-apart tines 58, as shown in FIGS. 1-6, extend from the radially outer perimeter segments 56A, 56B, 56C, 56D of the slanted redirecting areas 50 towards the outlet end 20, with predetermined tine angles, T, between about 0° and about 25°, and preferably between about 5° and about 20°.

The five spaced-apart tines 58 may also be characterized by relatively different predetermined tine angles. For example, referring to FIG. 5, the three adjacent spaced-apart tines 58B, 58C, 58D extending from a middle region of each of the radially outer perimeter segments 56A, 56B, 56C, 56D of the slanted redirecting area 50 towards the outlet end 20 is characterized by a predetermined tine angle, T, e.g., between about 3° and about 11°, and the two other spaced-apart tines 58A, 58E extending from opposite outer regions of each of the radially outer perimeter segments 56A, 56B, 56C, 56D of the slanted redirecting area 50 towards the outlet end 20 may be characterized by a predetermined tine angle, T, e.g., between about 9° and about 17°. Preferably, the predetermined tine angle, T, of tines 58B, 58C, 58D is about 7° and the predetermined tine angle, T, of tines 58A, 58E is about 13°.

Figure 5:
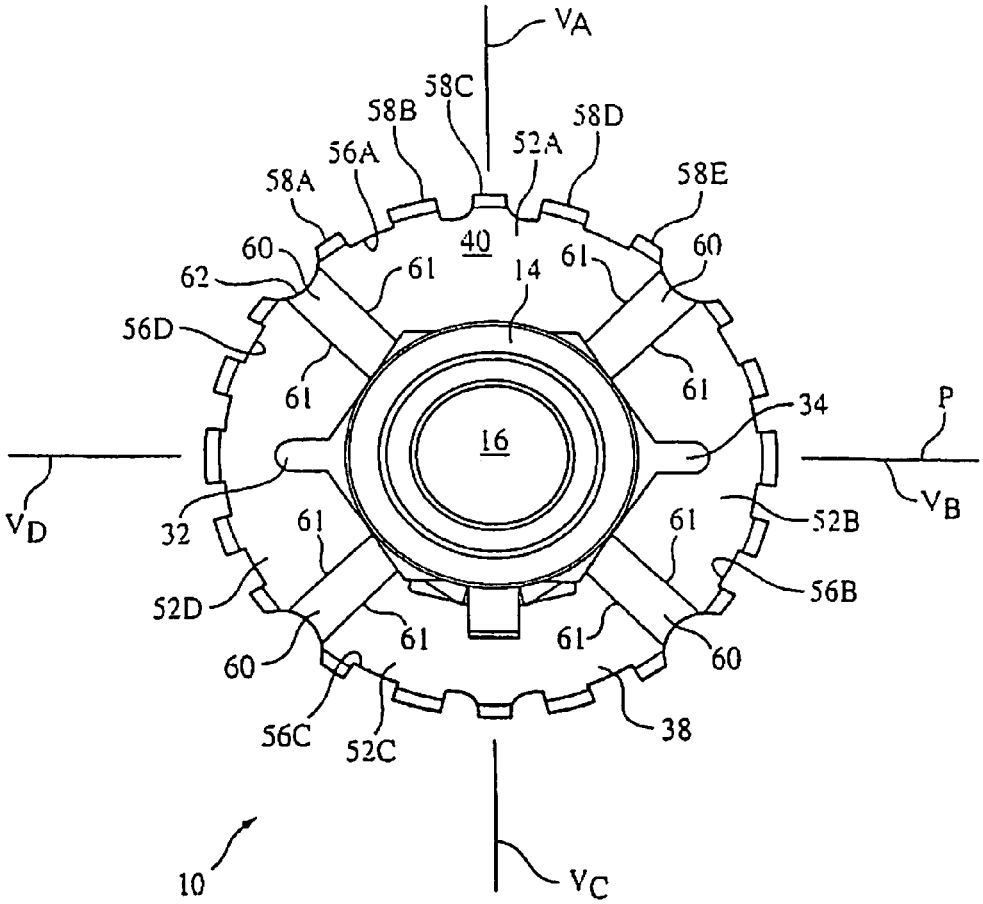
FIG. 5 is a bottom view of the low pressure, extended coverage, upright-type fire protection sprinkler of the invention.
Figure 6:
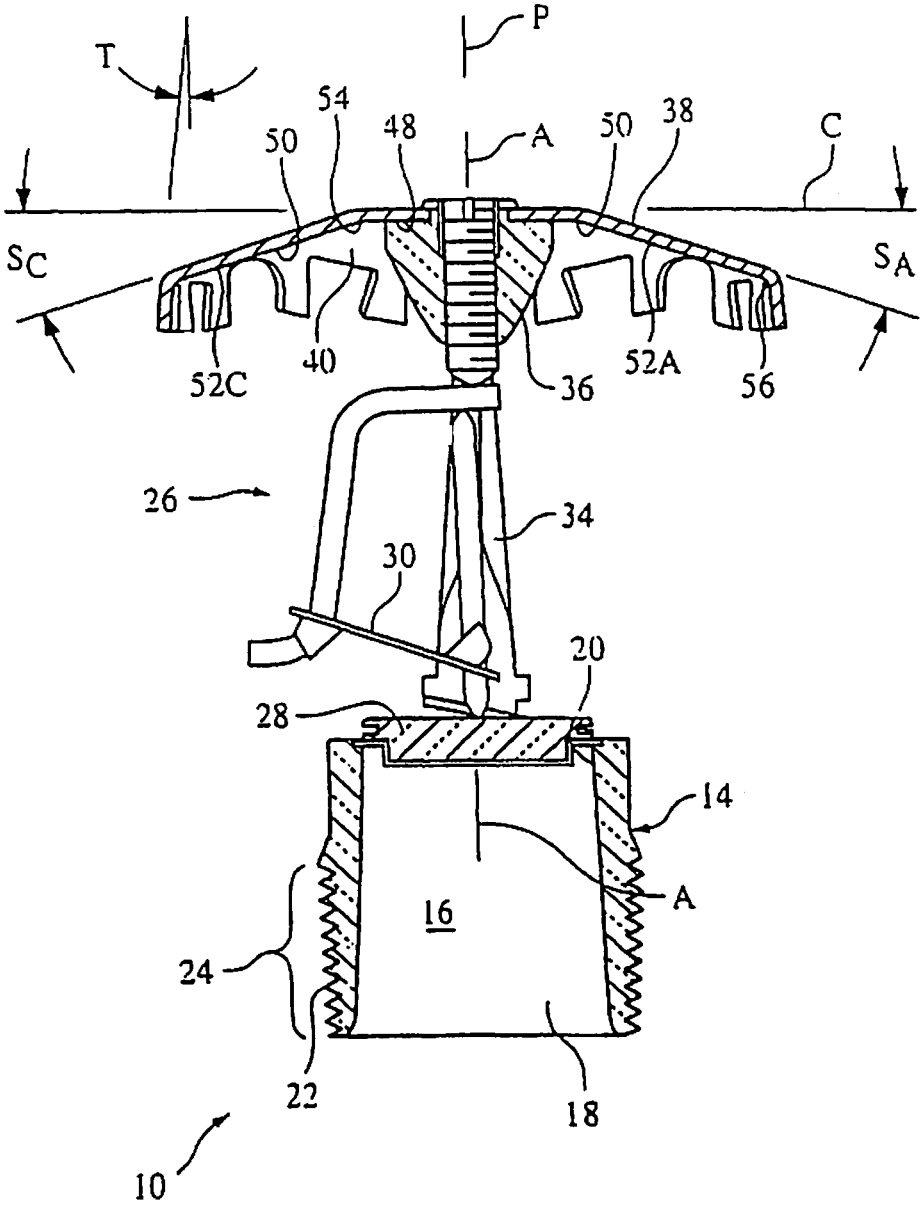
FIG. 6 is a side sectional view of the low pressure, extended coverage, upright-type fire protection sprinkler of another embodiment of the invention, taken at the line 6-6 of FIG. 2.

Intersections of the slanted, planar redirecting surfaces 52A, 52B, 52C, 52D of the inner surface 40, of the deflector 38 define formations or channels 60 radially bounded by creases 61 (FIG. 5). The shape of the formations may vary, e.g., with the value of the predetermined acute angle, $S_A$, $S_B$, $S_C$, $S_D$. For example, for a value of $S_A$, $S_B$, $S_C$, $S_D$ of about 20°, the shape of the formations preferably approximates that of a triangle; and, for a value of $S_A$, $S_B$, $S_C$, $S_D$ of about 30°, the shape of the formations preferably approximates that of a rectangle. Each formation or channel 60 extends radially outwardly and downwardly of the central area 48 to an enlarged, scalloped opening 62 (see, e.g., FIG. 2). The scalloped openings 62 are defined by adjacent spaced-apart tines 58 at corner regions of the radially outer perimeter 56 of slanted redirecting surfaces 52A, 52B, 52C, 52D, disposed at about 45° to the plane, P, generally of the support arms 32, 34, which is generally coplanar with the supply pipe, SP. As a result, a relatively lengthened flow of water is directed towards each corner region of the predetermined spray pattern disposed at about 45° to the supply pipe, SP.

Referring again to FIG. 1, according to one aspect of the invention, a fire protection sprinkler 10 of the invention has the form of a low pressure (e.g., 7 psig minimum), extended coverage fire protection sprinkler, suitable for use in protection of at least extra hazard and high piled storage occupancies, in accordance with the 1999 Edition of NFPA 13. The fire protection sprinkler 10 has a nominal discharge coefficient or K-factor of greater than about 16.0. In preferred embodiments, the K-factor is between about 18 and about 41, preferably between about 21 and about 35, more preferably between about 23 and about 27, and most preferably the K-factor is about 25.2. and each predetermined acute angle, $S_A$-$S_D$, is about 20°. Also in preferred embodiments, the Response Time Index, or RTI, of the heat-responsive trigger 30 of the thermally-responsive closure assembly 26 of sprinkler 10 is at least about 15 meter$^{1/2}$sec$^{1/2}$ (m$^{1/2}$s$^{1/2}$) and less than about 120 meter$^{1/2}$sec$^{1/2}$ (m$^{1/2}$s$^{1/2}$), preferably at least about 15 meter$^{1/2}$sec$^{1/2}$ (m$^{1/2}$s$^{1/2}$) and less than about 50 meter$^{1/2}$sec$^{1/2}$ (m$^{1/2}$, more preferably at least about 15 meter$^{1/2}$sec$^{1/2}$ (m$^{1/2}$s$^{1/2}$) and less than about 35 meter$^{1/2}$sec$^{1/2}$ (m$^{1/2}$s$^{1/2}$), and most preferably about 23 meter$^{1/2}$sec$^{1/2}$ (m$^{1/2}$s$^{1/2}$).

The heat-responsive trigger 30, e.g., as described in Martin et al. U.S. Pat. No. 4,893,679, the complete disclosure of which is incorporated herein by reference, consists of two, thin metallic links joined in face-to-face relationship by a thin layer of fusible solder. In the preferred embodiment, the links are formed of nickel alloy UNS NO2201 per ASTMB 152. Each link has a thickness, e.g., of about 0.0055 inch, and the fusible solder layer has a thickness, e.g., of about 0.001 inch. The trigger 30 has an overall width, e.g., of about 0.78 inch and an overall length, e.g., of about 0.88 inch. Martin et al. 679, in one embodiment, describes a heat-responsive trigger having a Response Time Index (RTI) between 40 ft$^{1/2}$sec$^{1/2}$) and 65 ft$^{1/2}$sec$^{1/2}$ (f$^{1/2}$s$^{1/2}$), i.e., between i.e., 22 meter$^{1/2}$sec$^{1/2}$ (m$^{1/2}$s$^{1/2}$) and 36 meter$^{1/2}$sec$^{1/2}$ (m$^{1/2}$s$^{1/2}$), as measured in accordance with the Factory Mutual Research Corp. (FM) Approval Standard (dated Jun. 18, 1996) in force at that time for establishing the approval requirements for Early Suppression-Fast Response Automatic Sprinklers. The FM requirements for Response Time Index (RTI) of Early Suppression-Fast Response Automatic Sprinklers have since been revised to specify limits of 35 ft$^{1/2}$sec$^{1/2}$ (f$^{1/2}$s$^{1/2}$) to 65 f$^{1/2}$sec$^{1/2}$ (f$^{1/2}$s$^{1/2}$), i.e., 19 meter$^{1/2}$sec$^{1/2}$ (m$^{1/2}$s$^{1/2}$) to 36 meter$^{1/2}$sec$^{1/2}$ (m$^{1/2}$s$^{1/2}$), as recited in Section 4.24.1 of Class Number 2008 Standard, dated August 1996. This FM standard does not recite any RTI requirements for low pressure (e.g., 7 psig minimum), extended coverage, fire protection sprinkler suitable for use in protection of at least extra hazard and high-piled storage occupancies, in accordance with the 199 Edition of NFPA 13.

In full scale fire testing conducted by FM for Grinnell Corporation Model EC-25 uprights sprinklers (25.2 K-factor. 165° F. nominal fuse temperature rating, with an RTI of at least about 15 meter$^{1/2}$sec$^{1/2}$ (m$^{1/2}$s$^{1/2}$) and less than about 35 meter$^{1/2}$sec$^{1/2}$ (m$^{1/2}$s$^{1/2}$)) embodying the invention, only a relatively few sprinklers, all in the immediate vicinity of the test fire, were activated. A few examples from this fire testing are provided below.

EXAMPLE 1

For full-scale fire testing, four tiers of Class 2 commodity were stacked in a double row rack arrangement to a height of 19 feet, 8 inches beneath a ceiling 30 feet high. Grinnell Corporation Model EC-25 sprinklers, as described above, were installed in an array on centers of 14 feet by 14 feet, with constant operating pressure of 8.5 psig (e.g., nominal discharge per sprinkler of 73.5 gallons per minute) at inlet ends of the sprinklers. A fire was ignited adjacent to the floor and in a position centered below four of the Model EC-25 sprinklers. The fire was rapidly subdued by operation of only four sprinklers in the immediate vicinity of the fire area.

EXAMPLE 2

For full-scale fire testing, three tiers of Cartoned Group A unexpanded plastic commodity were stacked in a double-row rack arrangement to a height of 14 feet, 8 inches beneath a ceiling 25 feet high. Grinnell Corporation Model EC-25 sprinklers, as described above, were installed in an array on centers of 10 feet by 10 feet, with constant operating pressure of 7 psig (e.g., nominal discharge per sprinkler of 67 gallons per minute) at inlet ends of the sprinklers. A fire was ignited adjacent to the floor and in a position centered below one of the Model EC-25 sprinklers. The fire was rapidly subdued by operation of only the one sprinkler directly over the fire area.

EXAMPLE 3

For full-scale fire testing, three tiers of Cartoned Group A unexpanded plastic commodity were stacked in a palletized arrangement to a height of 15 feet, 3 inches beneath a ceiling 25 feet high. Grinnell Corporation Model EC-25 sprinklers, as described above, were installed in an array on centers of 14 feet by 14 feet, with constant operating pressure of 22 psig (e.g., nominal discharge per sprinkler of 118 gallons per minute) at inlet ends of the sprinklers. A fire was ignited adjacent to the floor and in a position centered below four of the Model EC-25 sprinklers. The fire was rapidly subdued by operation of only two sprinklers in the immediate vicinity of the fire area.

A number of embodiments of the invention have been described. Nevertheless, it will be understood that various modifications may be made without departing from the spirit and scope of the invention. For example, although in the presently preferred embodiment, as described above, the deflector is mounted to the body by a pair of support arms, other numbers of support arms are contemplated, e.g. one support arm, or three or more support arms. Where other than two support arms, arrayed at 180° are employed, a plane of the support arms means a plane generally through at least one support arm and through the axis, A. Accordingly, other embodiments are within the scope of the following claims.

What is claimed is:

1. An upright-type fire protection sprinkler comprising:

a body defining an internal passageway extending between an inlet end and an opposite outlet end, the internal passageway having a K-factor between about 18 and about 41, where the K-factor equals an average flow of water in gallons per minute through the internal passageway divided by a square root of pressure of water fed into the inlet end of the internal passageway in pounds per square inch gauge, the outlet end having an axis; and a deflector mounted to the body by at least one support arm extending from the body and disposed in alignment with the axis and generally above and spaced from the outlet end of the internal passageway at a position with an inner surface of the deflector opposed to flow of water from the outlet end of the internal passageway, the inner surface of the deflector configured and arranged to deflect flow of water generally radially outwardly and downwardly of the sprinkler; wherein the inner surface of the deflector defines:

a generally planar central area intersecting and generally perpendicular to the axis, a redirecting area including four slanted redirecting surfaces extending from a radially outer peripheral edge of the central area, each at a predetermined acute angle, relative to a horizontal plane through the central area, with a radially outer perimeter of the slanted redirecting surfaces being axially relatively closer to the outlet than the central area, and a channel disposed between each of the four slanted redirecting surfaces, and a plurality of spaced-apart tines extending from the radially outer perimeter of the slanted redirecting surfaces, towards the outlet, at predetermined tine angles, measured relative to the axis, wherein each of the four slanted redirecting surfaces is substantially planar, wherein each of the redirecting surfaces is symmetrical about a vertical plane generally through its center, with an intersection of each of the vertical planes with each of the slanted redirecting surfaces defining the predetermined acute angle, measured relative to the horizontal plane through the central area, and wherein each of the predetermined acute angle is between about 10 degrees and about 40 degrees.

2. The sprinkler of claim 1, wherein each of the predetermined acute angle is between about 15° and about 35°.

3. The sprinkler of claim 2, wherein each of the predetermined acute angle is between about 20° and about 30°.

4. The sprinkler of claim 3, wherein each of the predetermined acute angle is about 20°.

5. The sprinkler of claim 4, wherein each of the predetermined acute angle is about 30°.

6. The sprinkler of claim 3, wherein the plurality of spaced-apart tines comprises two or more of the spaced-apart tines extending from the radially outer perimeter of each of the slanted redirecting surfaces towards the outlet.

7. The sprinkler of claim 6, wherein the plurality of spaced-apart tines comprises three or more of the spaced-apart tines extending from the radially outer perimeter of each of the slanted redirecting surfaces towards the outlet.

8. The sprinkler of claim 7, wherein the plurality of spaced-apart tines comprises five of the spaced-apart tines extending from the radially outer perimeter of each of the slanted redirecting surfaces towards the outlet.

9. The sprinkler of claim 6, wherein the predetermined tine angle of the two or more spaced-apart tines is between about 0° and about 25°.

10. The sprinkler of claim 9, wherein the predetermined tine angle of the two or more spaced-apart tines is between about 5° and about 20°.

11. The sprinkler of claim 7, wherein the predetermined tine angle of the three or more spaced-apart tines is between about 0° and about 25°.

12. The sprinkler of claim 11, wherein the predetermined tine angle of the three or more spaced-apart tines is between about 5° and about 20°.

13. The sprinkler of claim 8, wherein the predetermined tine angle of the five spaced-apart tines is between about 0° and about 25°.

14. The sprinkler of claim 13, wherein the predetermined tine angle of the five spaced-apart tines is between about 5° and about 20°.

15. The sprinkler of claim 7, wherein the five spaced-apart tines extending from the radially outer perimeter of each of the slanted redirecting surfaces towards the outlet are characterized by different predetermined tine angles.

16. The sprinkler of claim 7, wherein three adjacent spaced-apart tines extending from a middle region of each of the slanted redirecting surfaces towards the outlet are characterized by a predetermined tine angle between about 3° and about 11°, and two other spaced-apart tines extending from opposite outer regions of each of the slanted redirecting surfaces towards the outlet are characterized by a predetermined tine angle between about 9° and about 17°.

17. The sprinkler of claim 16, wherein the three adjacent spaced-apart tines extending from the middle region of each of the slanted redirecting surfaces towards the outlet are characterized by a predetermined tine angle of about 7°, and the two other spaced-apart tines extending from the opposite outer regions of each of the slanted redirecting surfaces towards the outlet are characterized by a predetermined tine angle of about 13°.

18. The sprinkler of claim 1, wherein the vertical plane through center regions of a first opposing pair of the slanted redirecting surfaces is substantially perpendicular to a plane generally of at least one of the support arm and the axis.

19. The sprinkler of claim 18, wherein the vertical plane through center regions of a second opposing pair of the slanted redirecting surfaces is substantially coplanar to a plane generally of at least one of the support arm and the axis.

20. The sprinkler of claim 19, wherein the plurality of spaced-apart tines comprises two or more of the spaced-apart tines extending from the radially outer perimeter of each of the first opposing pair of the slanted redirecting surfaces and three or more of the spaced-apart tines extending from the radially outer perimeter of each of the second opposing pair of the slanted redirecting surfaces.

21. The sprinkler of claim 20, wherein the spaced-apart tines extending from each of the first opposing pair of the slanted redirecting surfaces are characterized by a predetermined tine angle between about 10° and about 25°, and the spaced-apart tines extending from each of the second opposing pair of the slanted redirecting surfaces are characterized by a predetermined tine angle between about 10° and about 20°.

22. The sprinkler of claim 3, wherein the K-factor is about 25.2.

23. The sprinkler of claim 1, wherein the channel is radially bounded by a crease.

24. The sprinkler of claim 1, wherein the channel extends radially outward and downward of the central area to a scalloped opening.

25. An upright-type fire protection sprinkler comprising:

a body defining an internal passageway extending between an inlet end and an opposite outlet end, the internal passageway having a K-factor between about 18 and about 41, wherein the K-factor equals an average flow of water in gallons per minute through the internal passageway divided by a square root of pressure of water fed into the inlet end of the internal passageway in pounds per square inch gauge, the outlet end having an axis; and a deflector mounted to the body by at least one support arm extending from the body and disposed in alignment with the axis and generally above and spaced from the outlet end of the internal passageway at a position with an inner surface of the deflector opposed to a flow of water from the outlet end of the internal passageway, the inner surface of the deflector configured and arranged to deflect the flow of water generally radially outwardly and downwardly of the sprinkler;

wherein the inner surface of the deflector defines a central area, a plurality of redirecting surfaces proximate the central area, and a plurality of channels adjacent the plurality of redirecting surfaces.

26. The sprinkler of claim 25, wherein the central area comprises a generally planar central area intersecting and generally perpendicular to the axis, and the plurality of redirecting surfaces including four slanted substantially planar redirecting surfaces extending from a radially outer peripheral edge of the central area, with a radially outer perimeter of the slanted redirecting surfaces being axially relatively closer to the outlet than the central area.

27. An upright-type fire protection sprinkler comprising:

a body defining an internal passageway extending between an inlet end and an opposite outlet end, the internal passageway having a K-factor greater than about 16.0, wherein the K-factor equals an average flow of water in gallons per minute through the internal passageway divided by a square root of pressure of water fed into the inlet end of the internal passageway in pounds per square inch gauge, the outlet end having an axis; and a deflector mounted to the body by at least one support arm extending from the body and disposed in alignment with the axis and generally above and spaced from the outlet end of the internal passageway at a position with an inner surface of the deflector opposed to a flow of water from the outlet end of the internal passageway, the inner surface of the deflector configured and arranged to deflect the flow of water generally radially outwardly and downwardly of the sprinkler;

wherein the inner surface of the deflector defines a plurality of channels.

28. The sprinkler of claim 27, wherein the inner surface further defines a central area and the plurality of channels extend radially outward and downward of the central area.

29. The sprinkler of claim 28, wherein the inner surface further defines a redirecting surface between a pair of the plurality of channels.

30. The sprinkler of claim 29, wherein the redirecting surface is substantial planar.

31. The sprinkler of claim 29, wherein the plurality of channels comprise four channels and the plurality of redirecting surfaces comprise four redirecting surfaces.

* * * * *